US009380400B2

(12) United States Patent
Sprogis

(10) Patent No.: US 9,380,400 B2
(45) Date of Patent: Jun. 28, 2016

(54) OPTIMIZING AUDIO SYSTEMS

(71) Applicant: Sonarworks, SIA, Riga (LV)

(72) Inventor: Kaspars Sprogis, Salaspils (LV)

(73) Assignee: Sonarworks SIA, Riga (LV)

( * ) Notice: Subject to any disclaimer, the term of this patent is extended or adjusted under 35 U.S.C. 154(b) by 49 days.

(21) Appl. No.: 14/390,441

(22) PCT Filed: Apr. 4, 2013

(86) PCT No.: PCT/IB2013/000732
§ 371 (c)(1),
(2) Date: Oct. 3, 2014

(87) PCT Pub. No.: WO2013/150374
PCT Pub. Date: Oct. 10, 2013

(65) Prior Publication Data

US 2015/0078596 A1 Mar. 19, 2015

(30) Foreign Application Priority Data

Apr. 4, 2012 (LV) ..... P-12-55

(51) Int. Cl.
*H04S 7/00* (2006.01)
*H04R 5/027* (2006.01)

(52) U.S. Cl.
CPC ..... *H04S 7/302* (2013.01); *H04R 5/027* (2013.01); *H04S 7/301* (2013.01); *H04R 2499/13* (2013.01)

(58) Field of Classification Search
None
See application file for complete search history.

(56) References Cited

U.S. PATENT DOCUMENTS 5,572,443 A * 11/1996 Emoto ..... H03G 5/165 381/101
2005/0031143 A1 2/2005 Devantier et al.
2009/0308230 A1* 12/2009 Kayama ..... G10H 1/0091 84/622
2011/0091055 A1 4/2011 Leblanc

* cited by examiner

*Primary Examiner* — Wayne Young
*Assistant Examiner* — Mark Fischer
(74) *Attorney, Agent, or Firm* — David P. Dickerson

(57) ABSTRACT

A system with speakers in a listening environment is optimized acquiring data to determine characteristics of the acoustic field generated by the speakers. Test signals are supplied to the speakers and sound measurements made at a plurality of microphone positions in the listening environment. A set of parameters is generating reflecting a weighted frequency response curve, the set of parameters being calculated from the frequency response data weighted in proportion to a distance between a listening spot within the listening environment and the microphone position.

25 Claims, 22 Drawing Sheets

Fig. 29
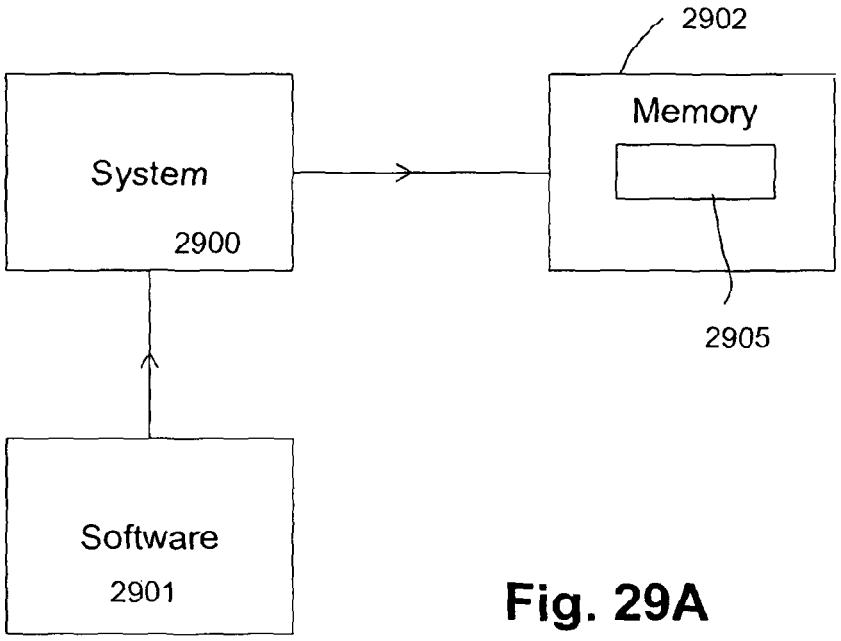
Fig. 29A
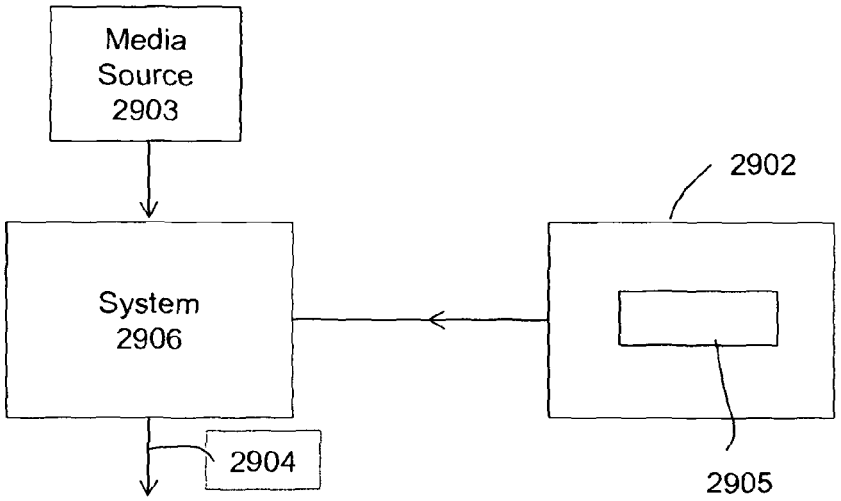
Fig. 29B

OPTIMIZING AUDIO SYSTEMS

RELATED APPLICATION

The present application is a national stage entry according to 35 U.S.C. §371 of PCT Application No.: PCT/IB2013/000732, filed on Apr. 4, 2013, which claims priority to Latvian Patent Application No. P-12-55, filed on Apr. 4, 2012.

BACKGROUND

This invention relates to acoustics and in particular to methods and apparatus for generating parameters for conditioning audio signals driving electro acoustic transducers to enhance the quality of sound.

It is known from US 2001/0016047A1 to provide a sound field correcting system in which test signals are played through loud speakers and the reproduced sound is measured to obtain data characteristic of the sound field. The sound field is then corrected by calculating parameters applied in a frequency characteristic correcting process, a level correcting process and phase correcting process when reproducing sound.

It is also known from CA 2608395A1 to correct acoustic parameters of transducers using data acquired at a series of different locations in the sound field.

US 2003/0235318 similarly describes measuring an acoustic response at a number of expected listener positions within a room in order to derive a correction filter which is then used in a filter in conjunction with loud speakers to reproduce sound which is substantially free of distortions.

The acquisition of the data in such system has hitherto been a task carried out by experts with knowledge of how to position microphones and measure their positions relative to loud speakers in a satisfactory manner. Such systems have therefore been difficult to implement in a context of home installations of hi-fi or cinema systems, or in sound recording or monitoring studios in the absence of professional assistance and measurement and analysis equipment.

SUMMARY

Embodiments of the present invention provide for the acquisition of data by measuring sound produced in response to test signals comprising both a position locating test signal and a frequency response test signal, thereby allowing microphone position and frequency response data to be acquired. User feedback via a user interface provides instructions for either a skilled or non-skilled user to perform a sequence of steps including moving the microphone to the required positions for data acquisition.

DESCRIPTION OF THE FIGURES

A method and apparatus in accordance with the present invention will now be described by way of example only and with reference to the accompanying drawings of which;

FIG. 29 is a schematic view of a studio set up in which the embodiment is utilised with a VST plugin;

DETAILED DESCRIPTION

Figure 1:
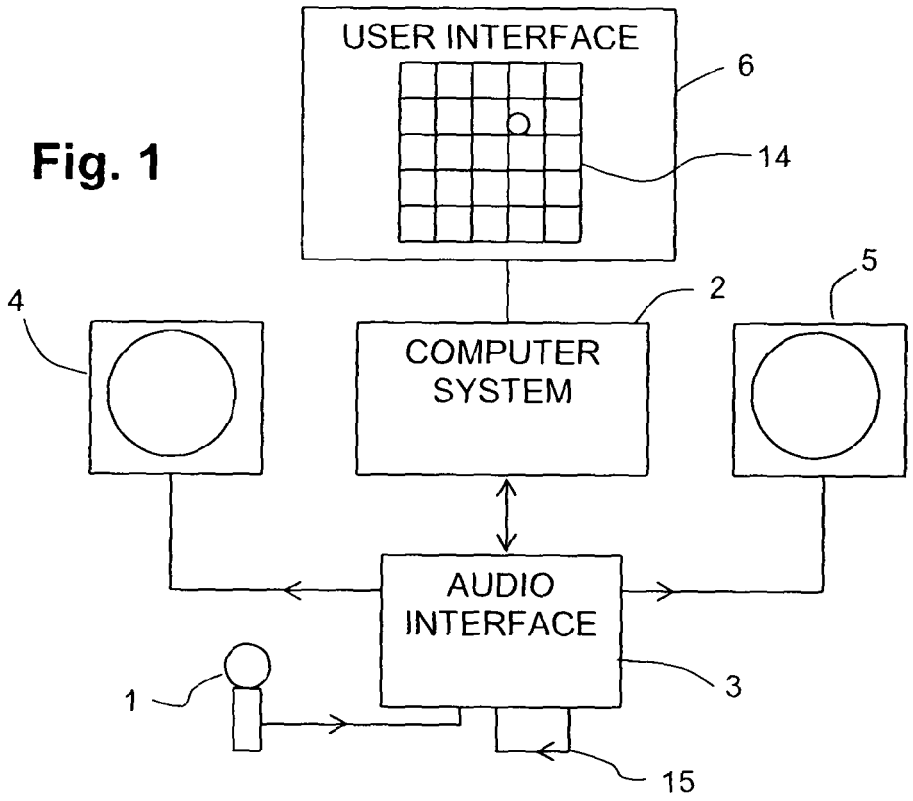
FIG. 1 is a schematic diagram of an audio system.

The embodiment of FIG. 1 schematically shows a computer system 2 having an audio interface 3 connected to left and rights speakers 4 and 5 and having a user interface 6. Reference herein to "speakers" includes any form of electro-acoustic transducer including active and passive loud speakers A microphone 1 is connected to the user interface 3.

The arrangement of FIG. 1 schematically represents a number of possible different scenarios. One example would be a recording studio in which a computer is provided with a dedicated audio interface for performing such tasks as analogue to digital and digital to analogue conversion, including pre-amps for processing microphone inputs, and having a output stage for driving loud speakers. Such a set up might be used in a recording studio where it is particularly important for the near field response of speakers 4 and 5 to be as free as possible from aberration and distortions arising both from the characteristics of the speakers and from the acoustic properties of the listening environment i.e. the room in which the equipment is located. In another example, the audio interface and computer system are both part of a domestic hi-fi or video system, television, or hybrid computer/television system used for high quality reproduction of media. In this example, the user interface might comprise the monitor screen of a computer or the video screen of a home cinema. The user interface although shown in this example as being a monitor screen, could equally well be an audio interface in which spoken voice synthesised or pre-recorded commands and instructions were issued to the user. Such voice synthesised commands could be processed for delivery through the speakers 4 and 5.

A further example might be where the computer system, audio interface and user interface formed part of a test equipment applied to speakers located in a particular listening environment, such as an interior of an automotive vehicle with a CD player and high fidelity playback. In this particular arrangement, the computer system and interfaces which are used in data acquisition for providing data to be preloaded into the audio system of production vehicles having the same acoustic characteristics in the listening environment provided by the vehicle interior by virtue of each vehicle having been manufactured to the same dimensions and with materials of identical properties.

The initial task to be described for each of the above scenarios is that of acquiring data including the amplitude/frequency response curve (herein after referred to as AFR) for the listening environment as measured at a listening location. The "listening location" herein is a reference to a position at which a person is located within the listening environment, typically defined by x, y coordinates in a horizontal plane.

In a preferred embodiment to be described below, a computer program is installed in the computer system 2 and includes the necessary software components for controlling the audio interface 3 and user interface 6 during a sequence of data acquisition steps in which the user is prompted to input instructions and selection of options for system configuration and is provided with prompts to perform tasks including microphone placement to enable data to be gathered.

An initial step requires the user to connect a microphone to one input channel of the audio interface and to select the speakers 4 and 5 to be used. In a simple scenario where for example near field monitors are provided in a small studio, two speakers 4 and 5 are provided at spaced apart locations. More complex systems include more than two speakers, including for example surround sound systems with the ability to create a more complex sound field. During data acquisition, microphone location requires the use of two speakers only so that triangulation can be used to measure microphone placement in a horizontal plane. Generally, speakers will be adjusted sequentially for producing sound to be measured by the microphone to determine the AFR. This need not necessarily be the case however, if for example there is a need to optimize performance in relation to a single channel or a sub-set of the available channels. The software package installed in the computer system 2 enables the acquisition process to be configured according to user requirements by displaying available options on the user interface 6 and prompting the user to enter a selection.

In the event that a single channel system is being used, having a single speaker, it would be necessary to provide an additional channel and speaker for the purpose of microphone position location during the acquisition of data.

Set-Up Stage

Figure 3:
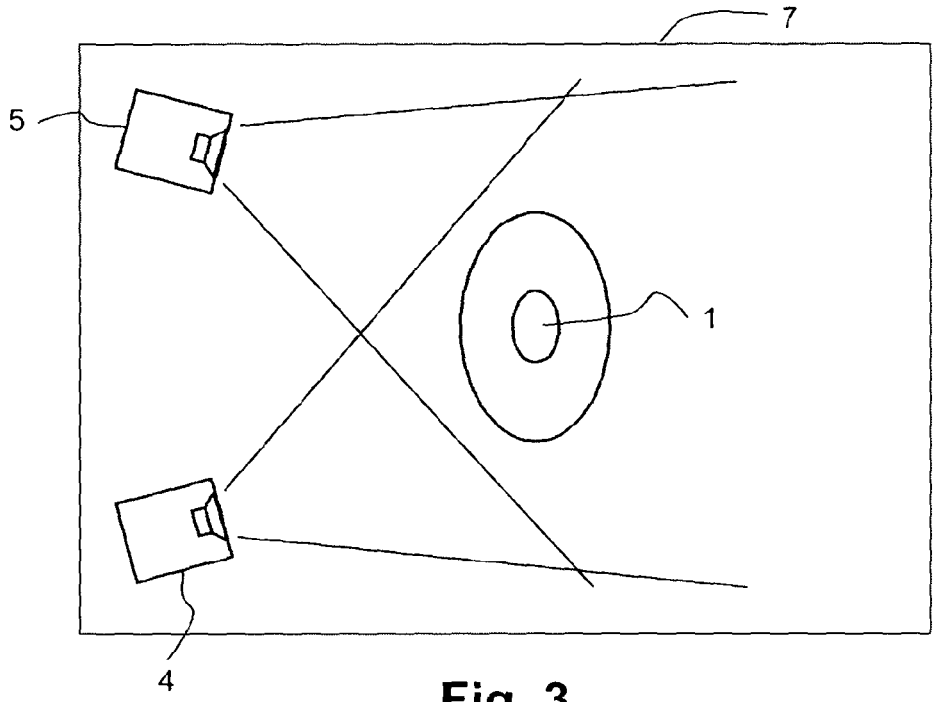
FIG. 3 illustrates schematically the approximate location of the measurement microphone during a set-up stage.
Figure 4:
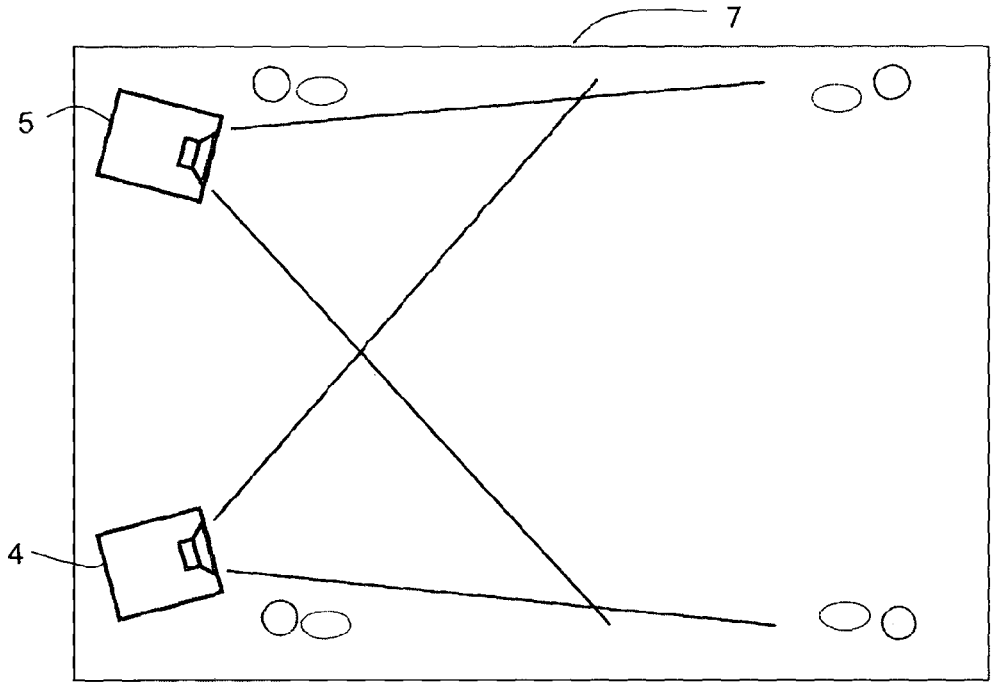
FIG. 4 illustrates schematically the location of the microphone during a listening area definition stage.

An initial set-up stage is followed to ensure that the system is correctly configured to allow test signals to be delivered and data acquired. FIG. 3 illustrates the location of the microphone 1 during the set-up stage at a location which approximately forms an equilateral triangle with apices at the microphone, left speaker 4 and right speaker 5. In the following discussion it is assumed that the speakers 4,5 and microphone 1 lie in a common horizontal plane. The microphone 1 will generally be an omnidirectional microphone with a flat frequency response and typically will be a condenser microphone held in a vertical position with the diaphragm uppermost. If a microphone 1 with a flat frequency response is not available, another type omnidirectional microphone may be used provided that the frequency characteristics are known and provided that the computer system is provided with data for compensating the frequency characteristics.

Figure 7:
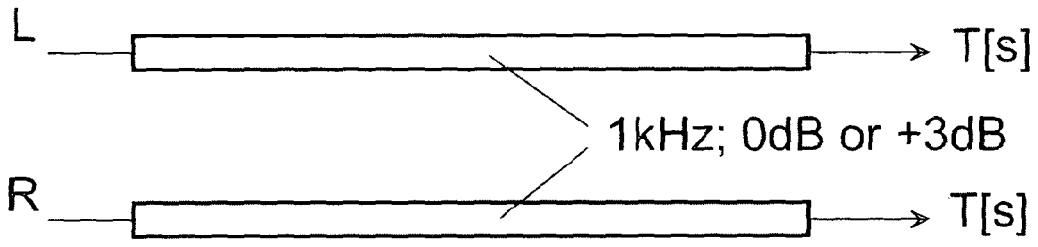
FIG. 7 illustrates test signals used in the set-up stage.
Figure 8:
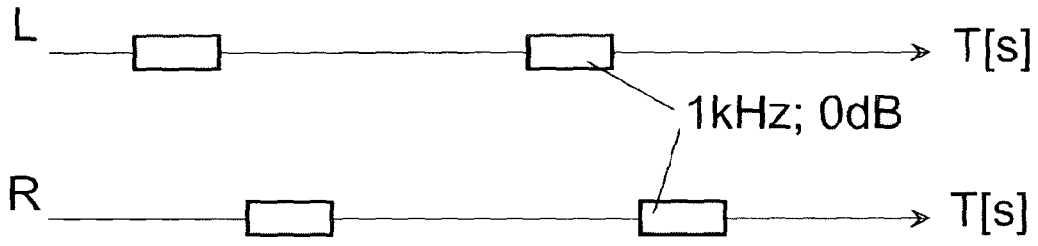
FIG. 8 illustrates test signals used for verifying microphone sensitivity.
Figure 9:
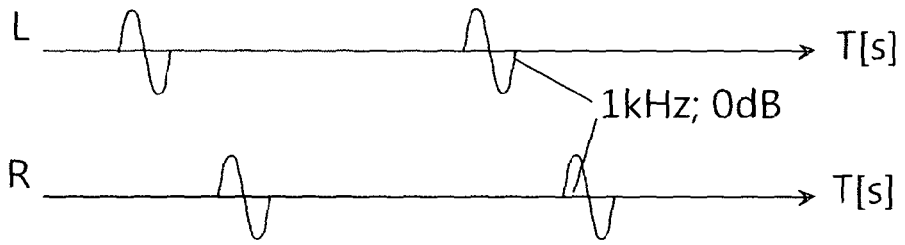
FIG. 9 illustrates test signals used for identifying speaker phasing during the set-up stage.

The set-up stage enables control and automatic set-up of all necessary settings for the system including sensitivity of input and output amplifiers, transducer channels and phasing, etc. The following test signals are used as the set-up stage.

a. a 1 kHz sinusoidal, continuous signal in both channels; for normalisation of the 0 dB device output level as shown in FIG. 7;

b. a 1 kHz sinusoidal, continuous, 1-second signal alternating in both channels as shown in FIG. 8 for verification of the 0 dB microphone input sensitivity;

c. a 1 kHz sinusoidal, 1-period 0 dB signal; for identifying the transducer phasing as sown in FIG. 9.

The test signal is used to verify the measurement microphone sensitivity referred to in point b, the typical length of each test package is 1 second (filled with a 1 kHz sinusoidal signal); a follow-up period is typically of 5 seconds with 1.5 seconds delay between channels. The time delay between test packets and the condition that only one speaker test package is played at the same time makes it possible to identify and test the signal level of each channel individually.

For the periodic test signal used to perform the steps in point c the typical length of each test package is one period of the basic signal tone (1 kHz) with a follow-up period of 5 seconds and a delay between channels of 1.5 seconds.

Figure 10:
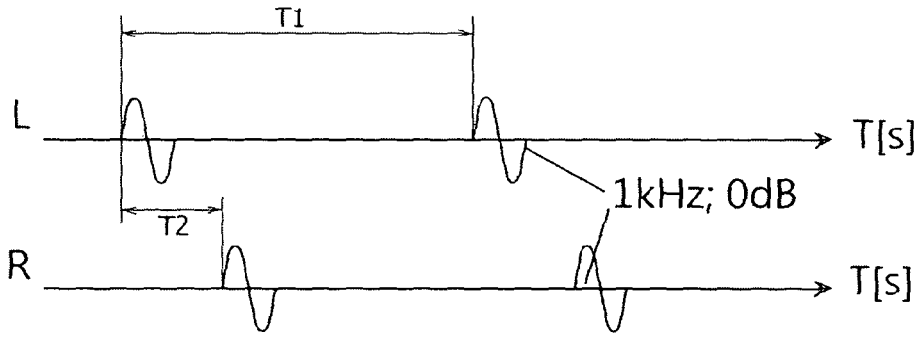
FIG. 10 illustrates the spacing of test signals to take account of reverberation time.

The individual test packages of each channel have to be sufficiently isolated in time (following with an identical period T1) so that the late reverberations (both from the given test signal and that of any other channel) have significantly attenuated acoustic power (or are completely vanished) and do not interfere with the measurements; the test packages must be time-delayed between channels (with a delay T2) so as to ensure that T2 is significantly different from T½, whereas the test signals of different channels do not overlap in time; as shown in FIG. 10.

Figure 11:
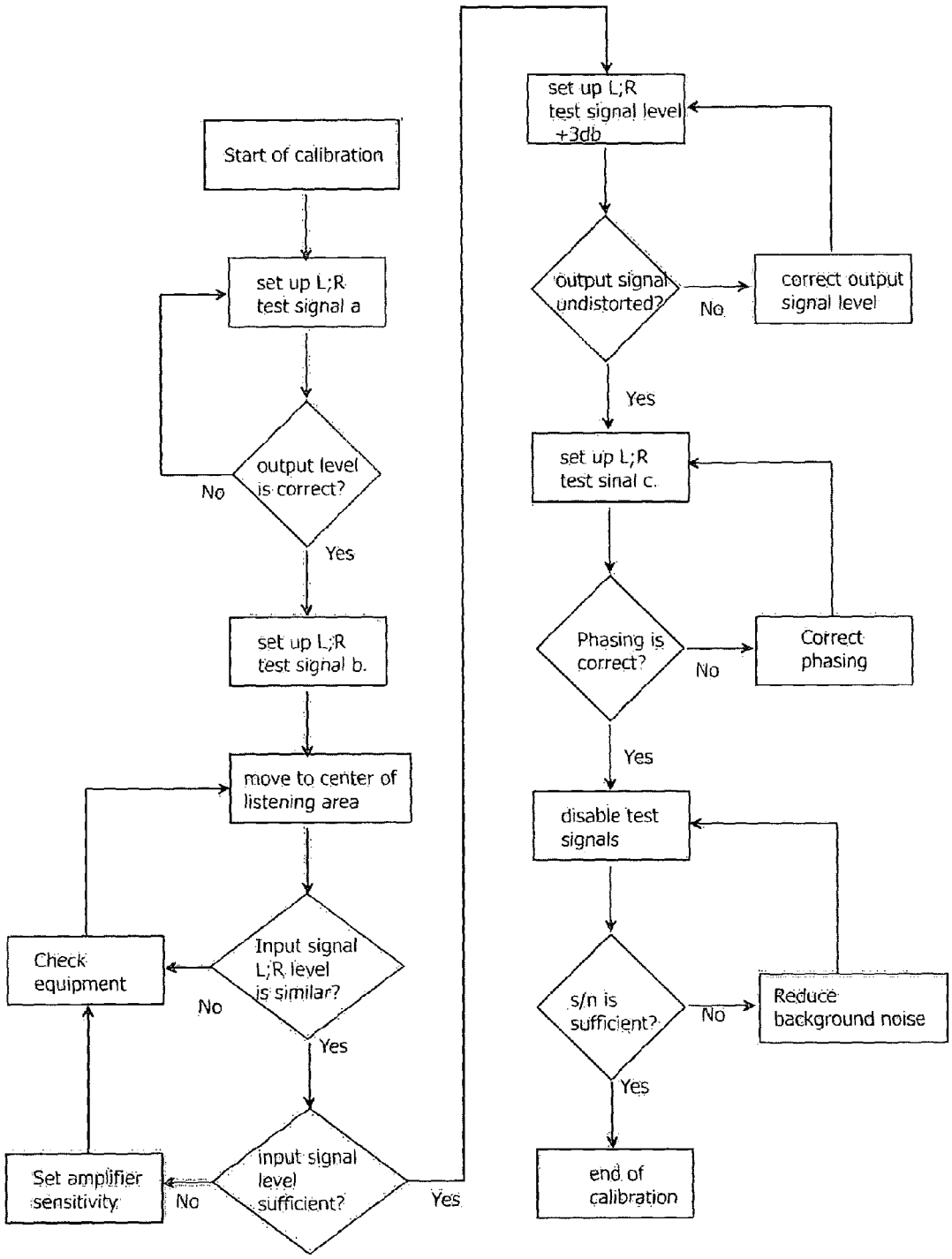
FIG. 11 illustrates schematically and algorithm for the set-up stage.

The operational algorithm of the set-up stage is shown in FIG. 11.

As can be seen from the operational algorithm of FIG. 11, the system automatically

- sets up the nominal signal level for outputs;
- verifies the presence of a signal in the measurement microphone (testing of the entire signal amplification and sound path);
- verifies channel identification;
- tests the capability of the audio interface to play signals without significant distortions;
- tests and directs the sensitivity adjustments of the measurement microphone 1;

tests the background noise level in the listening area: measures the level of the signal received from the measurement microphone 1 at a time when no signal is transmitted to the speakers;

verifies/corrects speaker phasing.

At the end of the set-up stage, the system is ready to acquire the necessary information required to define a listening area for which subsequent measurements and AFR correction are to be performed. This next stage will be referred to as the listening area definition stage.

Listening Area Definition Stage

Figure 2:
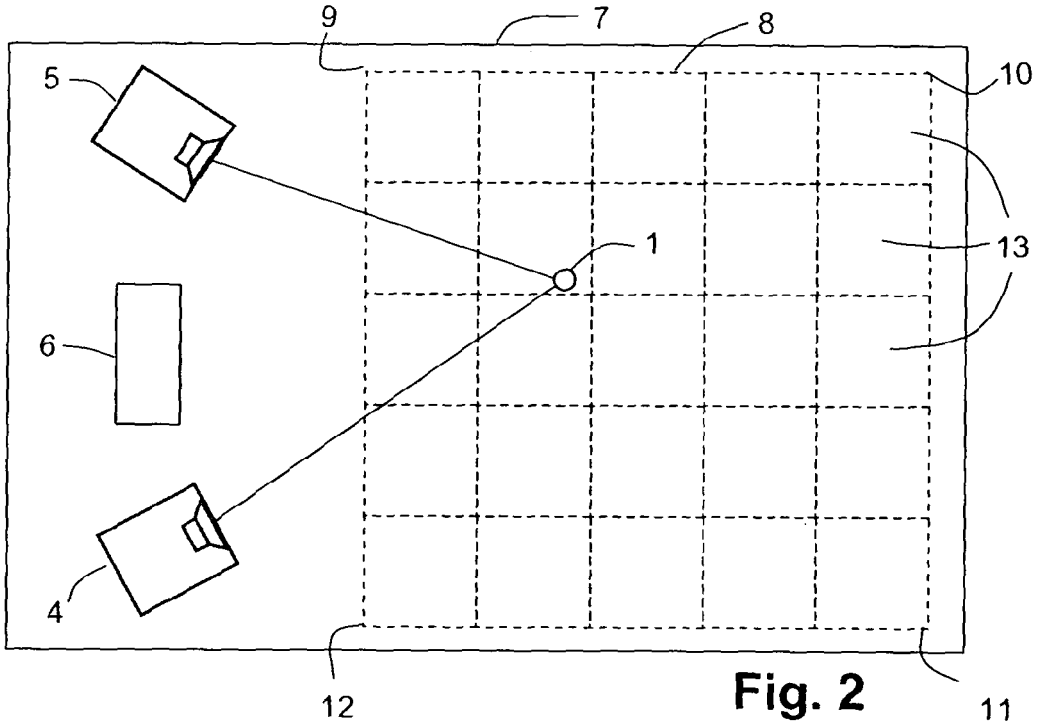
FIG. 2 is a schematic plan view of a listening environment in which the audio system of FIG. 1 is located.

FIG. 2 illustrates the relationship between the speakers 4,5 and the listening environment 7, or room, within which a listening area 8 is to be defined. In this embodiment, the listening area 8 is a rectangular figure which can be configured by the user setting the locations of corners 9, 10, 11 and 12. Generally, the listening area 8 is configured to cover all likely positions in the room at which listening is to be required.

The listening area 8 is divided into zones 13 in a rectilinear grid formation. Zones of other shapes and configurations are envisaged in further embodiments.

Figure 17:
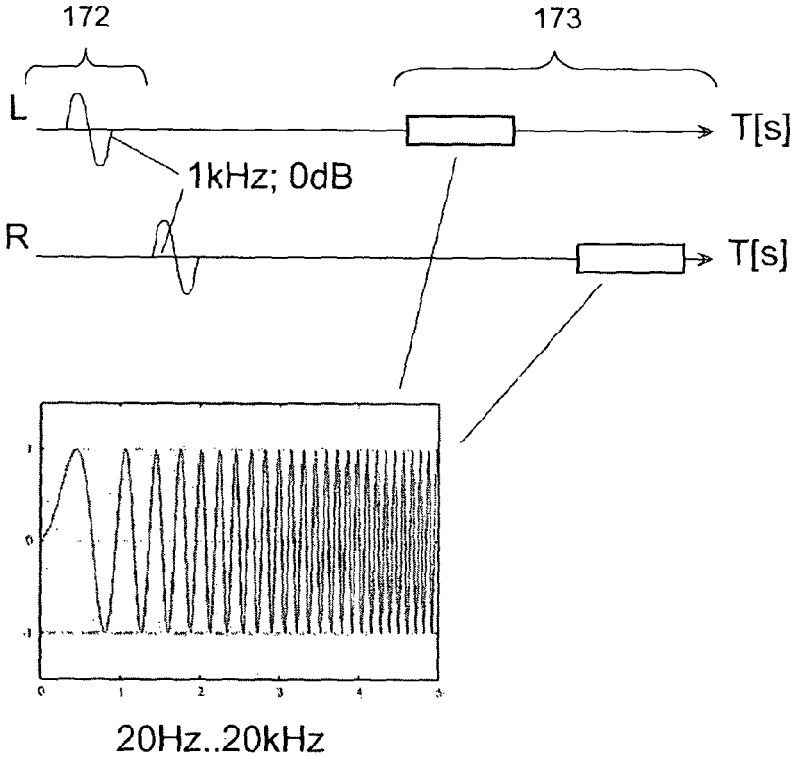
FIG. 17 illustrates schematically test signals used at a measurement stage.

The system needs to acquire a measurement of the separation between the two speakers used for triangulation measurement of the microphone 1 position. In this case, the distance between left and right speakers 4 and 5 needs to be determined. The system outputs via the user interface 6 an instruction to the user to place the microphone at a location immediately in front of one of the two speakers and position locating test signal 172 as shown in FIG. 17, and described in greater detail below, is supplied to the left and right speakers 4 and 5. The position locating test signals 172 result in sound pulses being emitted from each of the left and right speakers 4 and 5 and these are detected by the microphone 1. Assuming that the microphone has been placed against the left speaker 4, a microphone signal representing the detected sound pulse will be received by the system a short time after the position locating test pulse 172 is generated. This time interval is measured and provides an indication of the latency of the electronics communication path between the system and loudspeaker 4 and the short sound path between the speaker and microphone.

For the right-hand speaker, the detected time interval will be greater by an amount proportional to the physical separation between the left and right-hand speakers 4 and 5. The distance between the speakers can then be readily calculated from an assumed value of the speed of sound in air.

These measurements of latency in the electronics and physical distance between speakers are used in subsequent processing and analysis. A more accurate determination of the latency in the electronic pathway between signal generator and audio interface 3 output may be obtained using a loop-back connection as shown in FIG. 1 by loop connector 15. The loop connector 15 is connected to one of the microphone inputs of the audio device 3 and takes it output from one channel of the audio interface for example using the headphone socket. A signal pulse transmitted simultaneously to the speaker 4 and headphone socket output will result in both a received microphone signal and loop-back signal via loop-back connector 15 which, with the microphone placed close to speaker 4, allows the latency in the system to be measured. Subtracting the latency from subsequent timing signals measured using the microphone will correct for delays in the electrical signal path of the system and audio interface 3.

The listening area definition stage proceeds by the system 2 initially prompting the user to position the microphone at a first corner 9 of the listening area 8. When the positioning is confirmed by the user via the user interface 6, the system generates a position locating test signal which is supplied first to the left speaker 4 and subsequently to the right speaker 5, the resulting sound pulse being detected using the microphone 1 and the time of flight from speaker to microphone calculated in each case. From these calculations, the position of the microphone in x y coordinates can be determined by triangulation. This process is repeated for each of the remaining corners 10, 11 and 12.

The system 2 then prompts the user via the user interface 6 to select a level of granularity for dividing the listening area 8 into zones 13. FIG. 2 illustrates a 5×5 configuration in which there are 25 zones. Alternative configurations include 10×10, 50×50 and 100×100. The choice of granularity needs to be appropriate to the room size. Generally the size of a zone 13 should be no less than the dimensions of a persons head.

Figure 12:
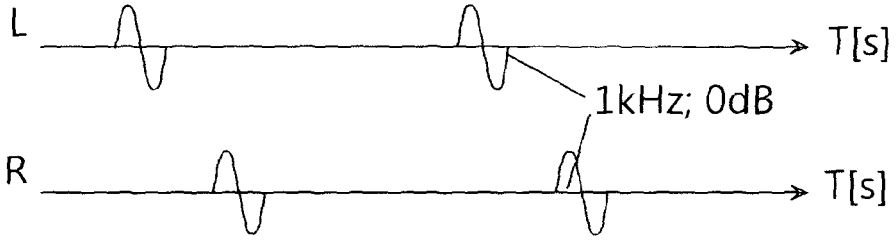
FIG. 12 illustrates test signals used in the listening area definition stage.

An example of a suitable position locating test signal is given in FIG. 12 in which the position locating test signal is a single cycle of a 1 kHz sinusoidal waveform. A frequency of 1 kHz will be appropriate for most systems but the frequency may be varied to suit specialised systems if required.

The example of FIG. 12 uses a delay of 1.5 seconds between left and right channels.

Figure 13:
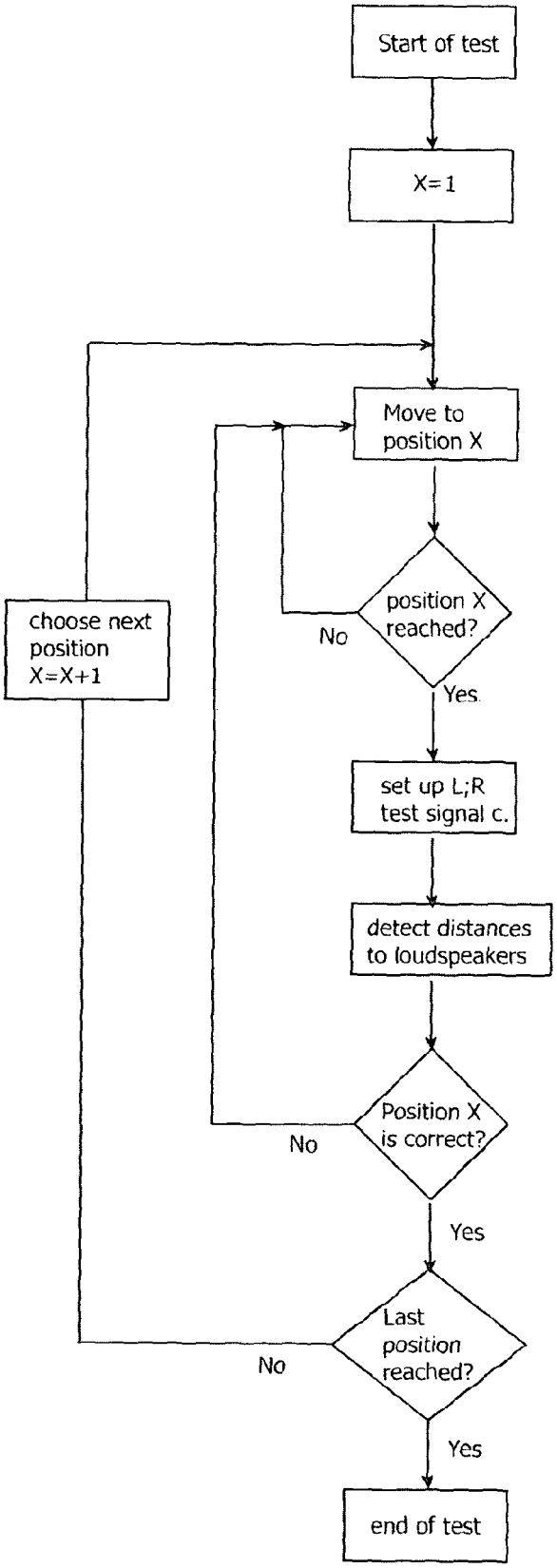
FIG. 13 illustrates schematically the process used in the listening area definition stage.
Figure 14:
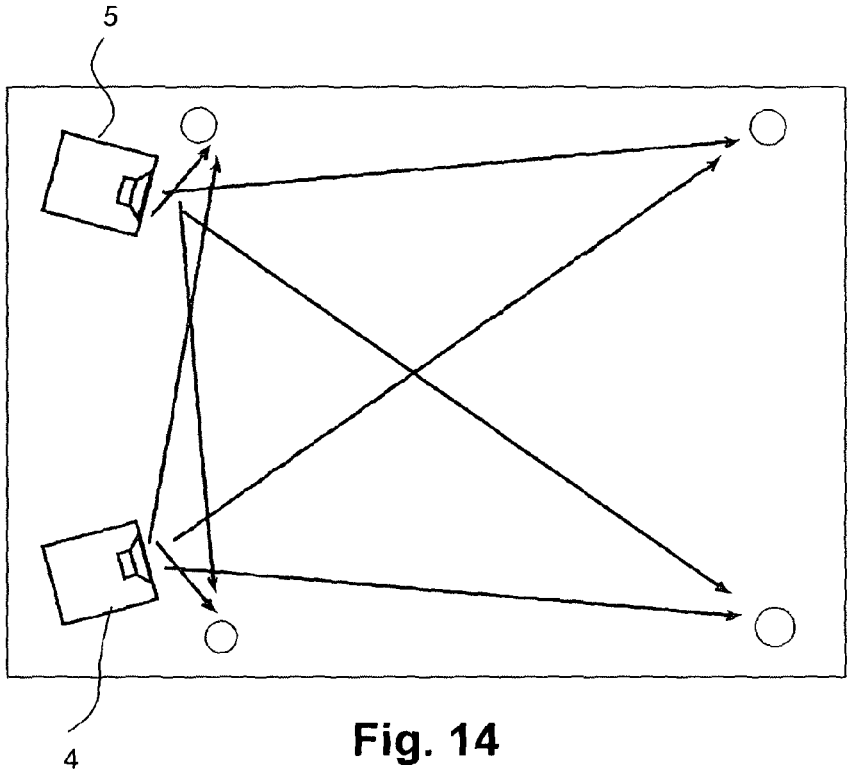
FIG. 14 illustrates the path of microphone movement required to identify the four corner coordinates of the listening area.
Figure 15:
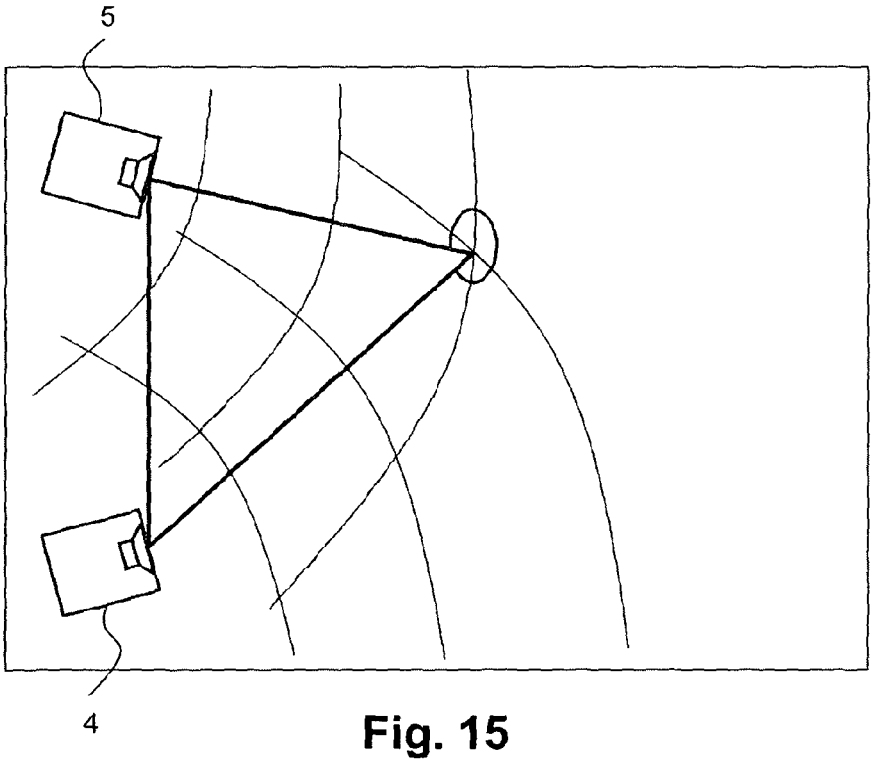
FIG. 15 illustrates the application of trigonometric calculations to determine microphone position.
Figure 16:
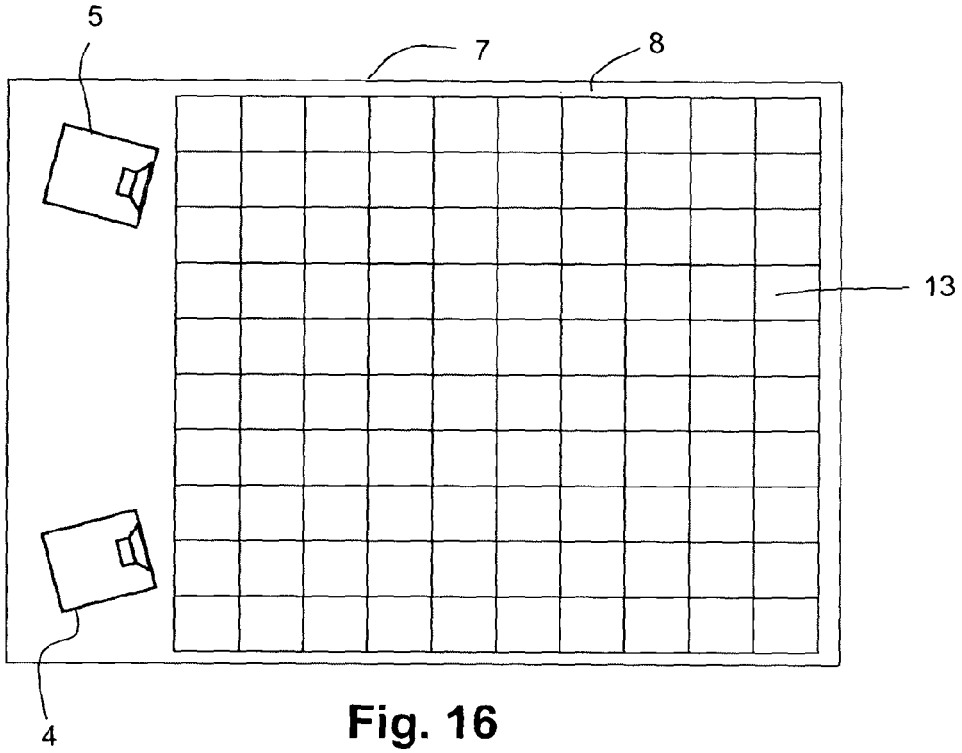
FIG. 16 illustrates the divisional of the listening area into zones.

FIG. 13 illustrates schematically the process used in the listening area definition stage.

At the end of the test, the system has acquired the x, y coordinates of each of the corners of the listening area 8 and has determined the number of zones 13 and their positions relative to the speakers 4 and 5.

The system 2 then prompts the user via the user interface 6 to move on to the next stage in which measurements are made at microphone positions in different zones 13 throughout the listening area 8. This next stage will be referred to as the measurement stage.

Measurement Stage

During the measurement stage, the microphone 1 of FIG. 2 will be located at a number of different positions within the listening area 8 by the user in response to instructions provided by the user interface 6. The objective in this stage is to acquire frequency response data for each of the zones 13, with measurements being repeated at different locations within each zone so as to acquire for each zone a predetermined number (for example 10) of sets of frequency response data which can be subsequently analysed.

The user can be guided during this process via the user interface 6 in a number of ways. In the preferred embodiment, instructions are displayed on a video monitor so as to include a graphical representation 14 as shown in FIG. 1 of the listening area 8, the zones 13 and the currently calculated position of the microphone 1.

The graphical representation 14 may for example display zones 13 in different colour according to whether sufficient data has been required for each zone. The user is then invited by the system 2 to move the microphone 1 so as to appear in the graphical representation of other zones requiring further data to be gathered during the measurement stage.

Alternative embodiments make use of synthesised speech to issue instructions to the user for data gathering. A hybrid system would use a combination graphical representation and synthesised speech. The synthesised speech may be delivered via the speakers 4 and 5 or via an alternative system, or for example via the headphone socket of the audio interface.

FIG. 17 illustrates the test signal 171 supplied to the left and right speakers 4 and 5, the test signal comprising a position locating test signal 172 and a frequency response test signal 173. The position locating test signal 172 consists of one cycle of a sinusoidal wave of 1 kHz period supplied to the left speaker 4, followed by a corresponding signal supplied to the right speaker 5. This is followed by the frequency response test signal 173 which first comprises a sinusoidal signal of swept frequency covering the frequency range 20 Hz to 20 kHz, supplied first to the left speaker 4 and then a corresponding swept frequency signal subsequently to the right speaker 5.

This pattern of test signal 171 at a given microphone location results in the speakers 4 and 5 generating acoustic waves which enable the position of the microphone 1 to be determined by triangulation from sound measured by the microphone in the response position locating test signal 172 and then the required frequency response data to be acquired by recording and digitizing the sounds measured by the microphone in response to the frequency response test signals for each of the left and right speakers 4 and 5.

The separation between the position locating test signal 172 and frequency response test signal 173 is typically in the range 0.1 to 5 seconds. The duration of the frequency response test signal is typically in the range 0.3 to 2 seconds.

Figure 18:
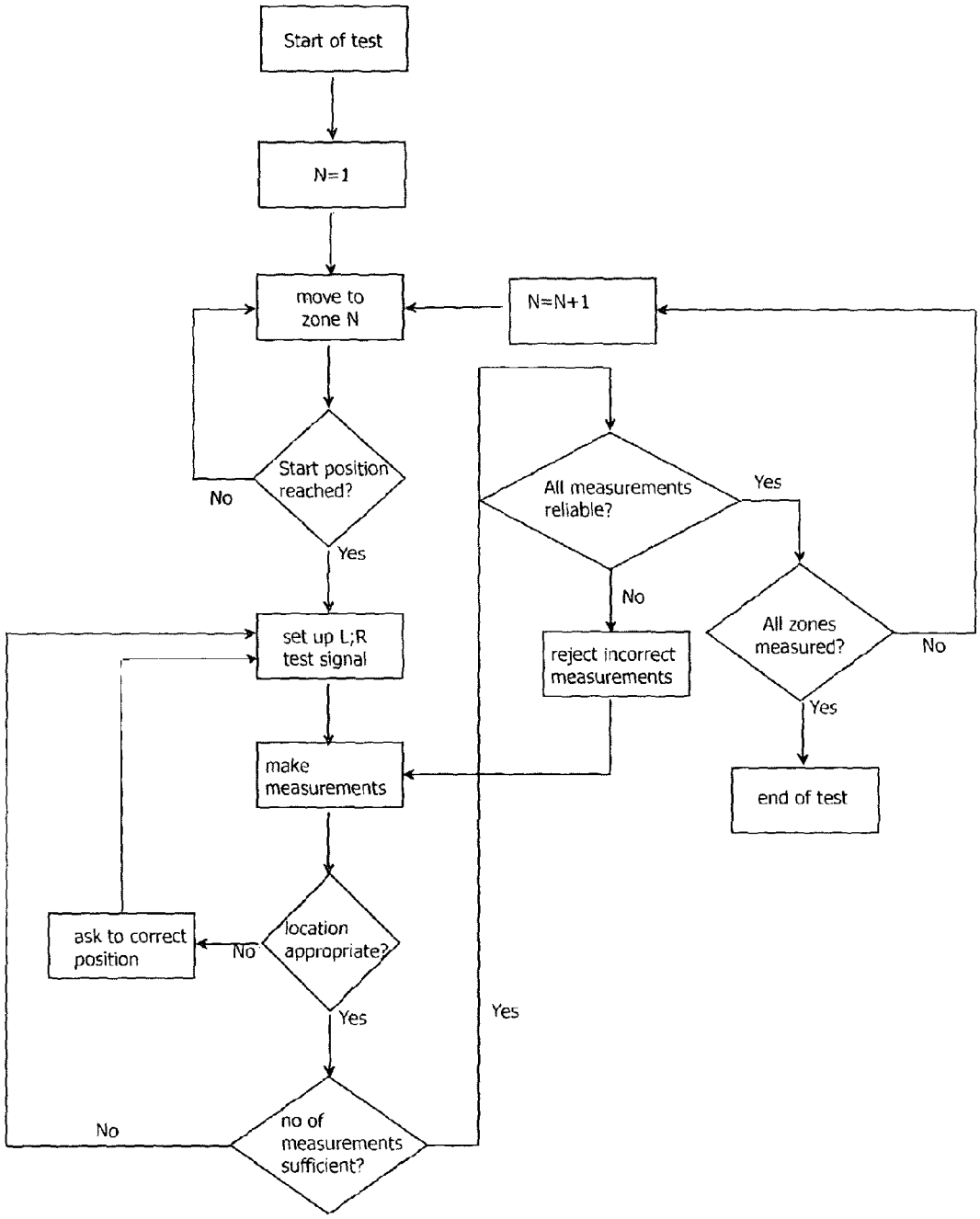
FIG. 18 illustrates schematically the operational algorithm of the measurement stage.
Figure 19:
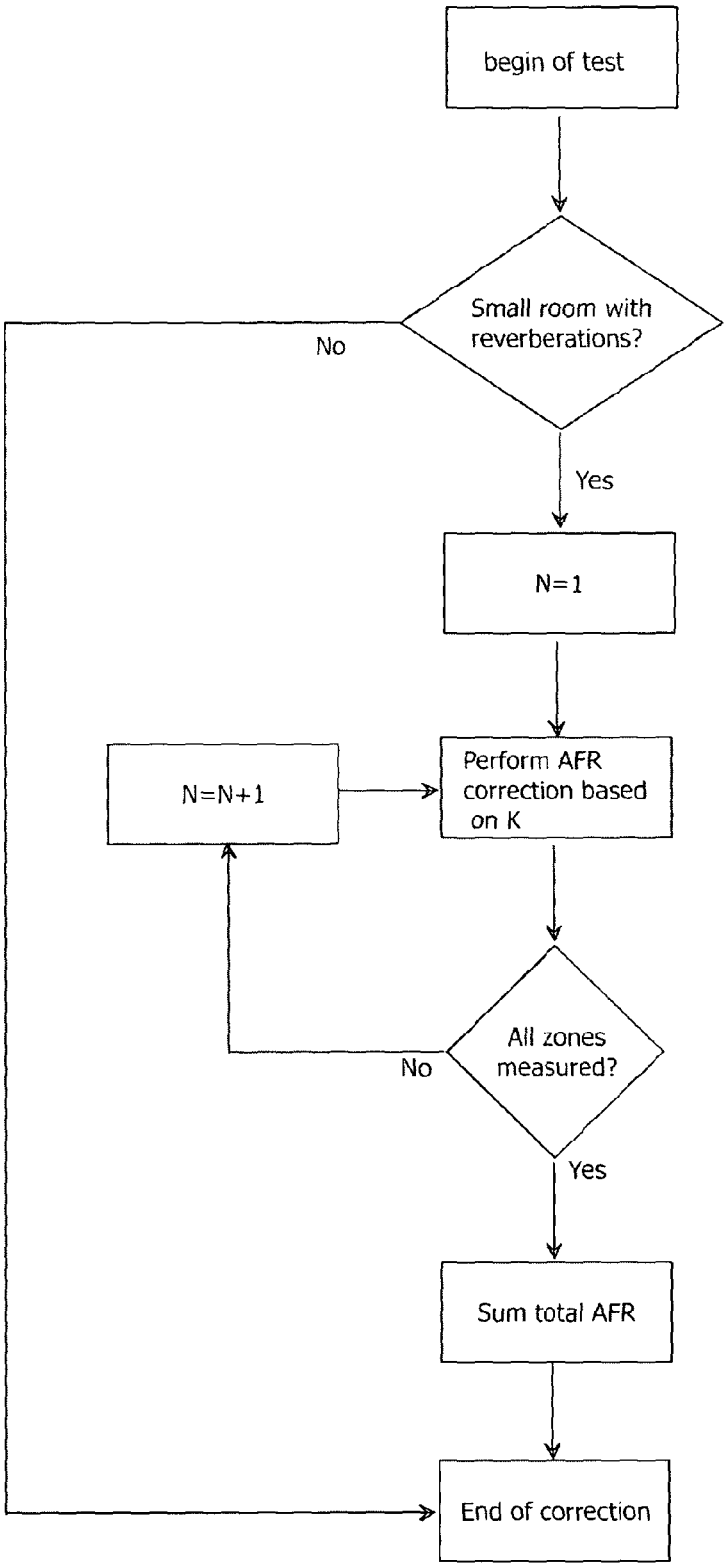
FIG. 19 illustrates schematically the operational algorithm used in correction for small room reverberation.

The choice of time interval separating the signals 172 and 173 may be configured in response to user input via the user interface 6 to take account of the reverberation time which is characteristic of the listening environment 7. If there is a long reverberation time, an extended time interval would be preferred in order to avoid overlap between the acoustic response to the test signals 172 and 173. This selection may be automated by analysis of the response obtained to a pulse of pink or white noise output by delivering a further test signal to the speakers and detecting the resulting sound waves by the microphone 1. Other forms of test signal can be used in alternative embodiments FIG. 18 illustrates schematically the algorithm controlling the flow of steps within the measurement stage.

During the measurement stage, a succession of frequency response measurements will be made within each zone 13. For a given zone, each set of values of the AFR comprises sound energy levels for each of a number of discreet frequencies. Spurious or invalid measurements are excluded by applying statistical analysis to determine unreliable data and deleting such data.

One way of performing such analysis in a given zone is to maintain for each frequency value a set of average sound energy values of the measured sound energy, i.e. if there are N microphone positions within the zone at which measurements are taken, for each frequency an average of the N measured values is calculated. Any new measurement which has at least one frequency at which the measured energy value falls outside of ±6 dB from this average is rejected as being spurious or invalid and a further measurement is requested from the user. There may be other criteria for rejecting data, such as discrepancies in the microphone position data between successive samples. Such measurements can be excluded by applying a threshold criteria and rejecting new measurements for which a calculated change in microphone position between successive position measurements exceeds the threshold.

Once the data has been acquired, a further step of processing the measured data then follows.

Measurement Processing Stage

The measurement processing stage is required to combine for each zone 13 of FIG. 2 the measurements made at a set of microphone positions within the zone. Also during the measurement processing stage, the system 2 prompts the user to enter information regarding the relative importance as listening areas of each of the zones, dictated either by personal preference or practical considerations such as where there is seating in the listening environment.

The relative importance of each zone 13 is represented by a weight index assigned for each zone. In the present embodiment, weight indices can be assigned a value between 0 and 1 where a weight index of 1 indicates a main listening zone, a weight index of 0.7 indicates an important listening zone, a weight index of 0.2 indicates a less important listening zone and weight index of 0 indicates an unimportant listening zone where for example audience presence is not intended.

A measured AFR is calculated based on the accumulated data for each zone 13 with the assigned weight index being applied to the data for each zone in a manner such that zones with an index of zero have no contribution to the final result whereas zones having a non 0 index have a contribution which is proportional to the value of the index.

Figure 20:
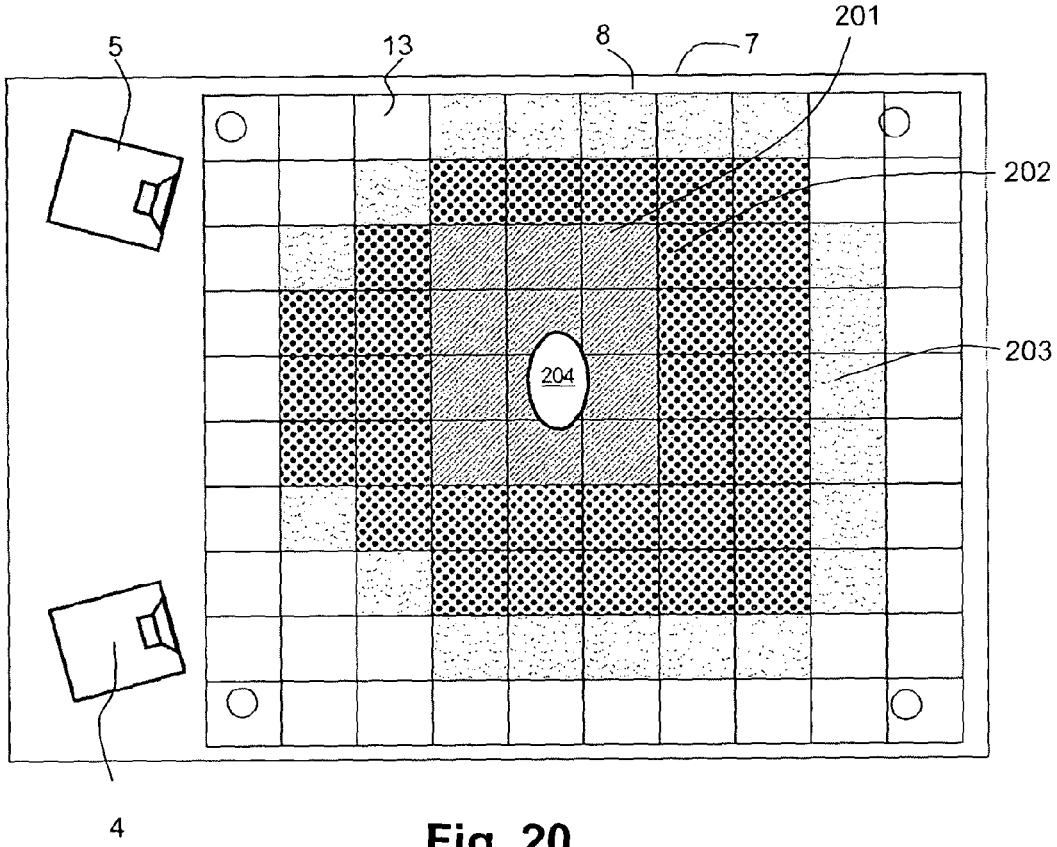
FIG. 20 illustrates a map of zone weighting indices.

FIG. 20 gives an example of a map of zone weighting indices as displayed on the user interface 6. In this example, zone 201 is a main listening zone, zone 202 is an important listening zone and zone 203 is an unimportant zone where audience presence is not intended.

The weighting of data may be carried out for example by taking the measurements from each zone at a particular frequency and performing a weighted average using the weights assigned to each zone. This is repeated for each of the frequencies where measurements are made and the end result is a weighted AFR which reflects the listening preferences of the user in terms of relative preference of listening locations in the listening environment 7.

During the measurement processing stage, further adjustment may be required to the low frequency data particularly in the case of the listening environment 7 being a small room in which reverberation between the walls becomes a significant factor in colouring the perceived sound. Other factors such as the acoustic properties of the walls etc. may also make reverberation problematic.

FIG. 20 also illustrates a preferred listening spot 204 which is selected by the user using the user interface 6 as the ideal listening position. The coordinates of this preferred listening spot 204 are used for calculating delay and level adjustment data which are to be used as part of the correction parameters to be applied to an audio signal during sound reproduction in order to take account of the difference in distance between the preferred listening spot and each of the speakers.

Figure 21:
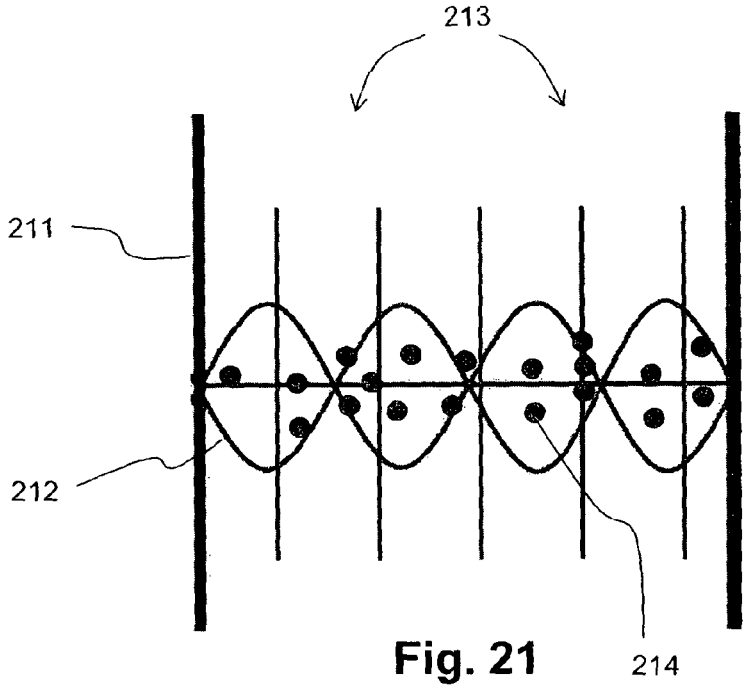
FIG. 21 illustrates the formation of standing waves between parallel walls in the listening environment.

FIG. 21 illustrates the formation of standing waves between parallel walls in such a small room. The walls 211 are parallel and closely spaced resulting in standing sound waves being generated, represented schematically by a standing wave 212. The dividing lines 213 between adjacent zones are separated by a distance which is comparable with the standing wavelength and measurements made at microphone positions 214 can be expected to be markedly different according to location along the standing wave. This problem can be addressed by processing data for low and high frequencies in a different manner to higher frequencies. A cut-off frequency is selected, in the present example the cut-off frequency is selected to be 300 Hz, and all sound energy measurements for frequency components below the cut-off frequency are given a weight index k which tends towards 1 for all zones, irrespective of user preference for weight index. The value of k may be selected to be 1 if required. For all the remaining frequencies above the cut-off frequency, the user preference of weight index is applied.

Figure 22:
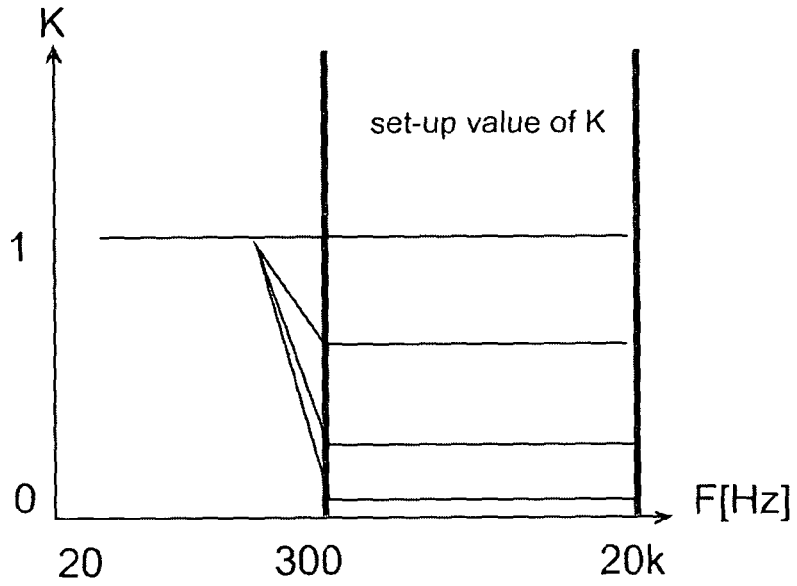
FIG. 22 is a graphical depiction of an AFR processing algorithm for small listening areas.
Figure 23:
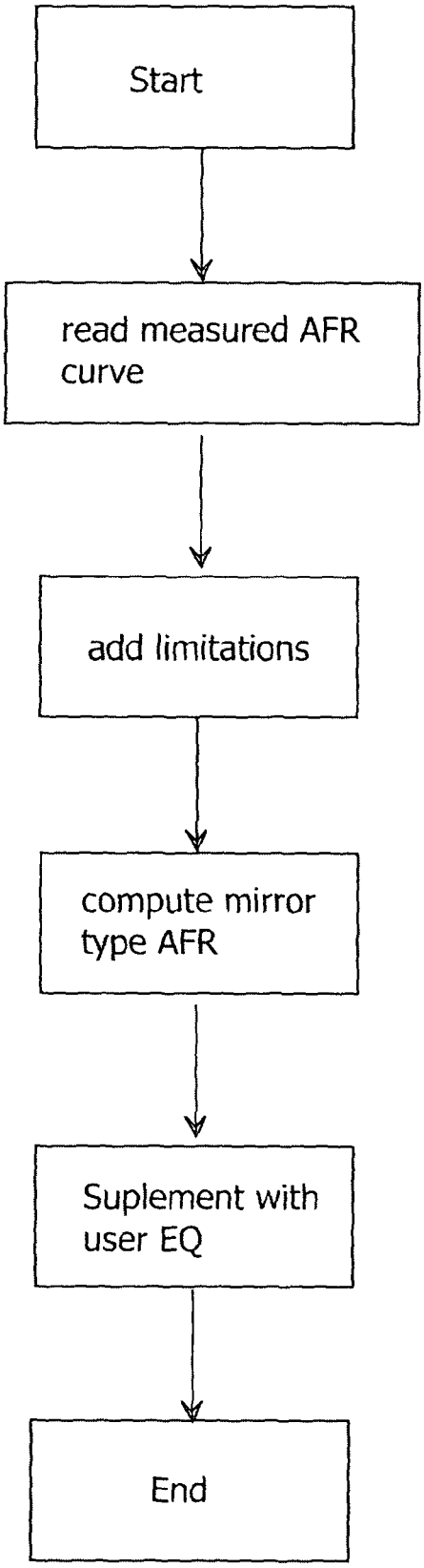
FIG. 23 is a schematic diagram of an algorithm for a stage of generating correction parameters.

This process is indicated schematically in FIG. 22 which shows that multiple values of weight index k are available above the cut-off frequency of 300 Hz whereas below the cut-off frequency a single weight index is applied to all zones.

Generating Correction Parameters Stage

The next stage is to generate correction parameters which can be used in correcting the sound field by conditioning the signals supplied to the speakers 4 and 5 of FIG. 1 during playback of audio when the system is in use. (The term "conditioning" in the present context includes modifying the signals to achieve an improvement in the resulting sound field. The correction parameters may include equalization parameters which apply an equalization curve to correct the measured frequency response as perceived by listening at the operator selected listening positions. Other parameters include phase correction parameters and delay correction parameters.

The AFR curve which has been obtained with zone weighting according to user preference is compared with a target AFR curve which in a default situation could simply be a flat linear frequency response. The system 2 via the user interface 6 however invites the user to apply a different target curve such as for example one in which bass frequencies are boosted or in another example high frequency roll-off is applied to decrease progressively high frequency components. Subtracting the target curve from the measured and weighted AFR curve yields a correction curve, or a set of values for different frequencies where each value represents a correction to be applied to the gain of a digital filter applying different gains to each frequency component.

The output of the stage of generating correction parameters is a file containing FIR coefficients plus level and latency information. This file will henceforth be referred to as a filter file. (Other types of filter such as a minimal phase filter will require data in an appropriate format).

The filter file may be used by the computer system 2 in the system of FIG. 1 during subsequent use of the system for example in a recording studio for monitoring in real time sound being recorded, or for playback during mixing, mastering or post production. Alternatively, the filter file may be exported and input to another system which is to provide audio signals to the speakers 4 and 5 in the sound environment 8 as shown in FIG. 2. This possibility might arise for example during professional installation of a cinema sound system where a dedicated system is used for setting up and the installed system uses the filter file obtained by the dedicated system. A third possibility is that the file will be exported for use in a system which is providing audio signals to speakers in another sound environment which is substantially identical to or believed to have similar acoustic properties to the sound environment 7 in which measurement data has been acquired and processed in order to obtain the filter file. This latter possibility would arise for example in the case of automotive production where a test vehicle having a sound system could be used to obtain measurements and the filter file exported from the measurement process could be supplied to each vehicle subsequently equipped with an equivalent listening environment (vehicle interior) and having a sound system with speakers configured in the same way as those within the listening environment of the test vehicle where the measurements were taken.

Figure 24:
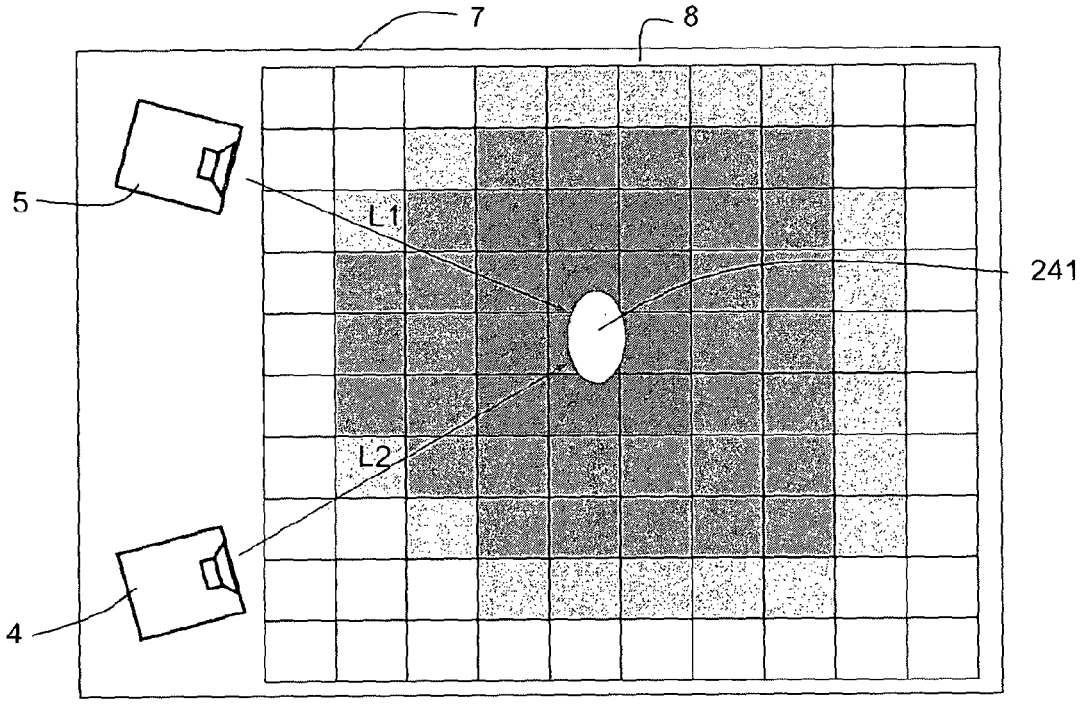
FIG. 24 illustrates a typical position of a central listening area which requires delay correction.
Figure 25:
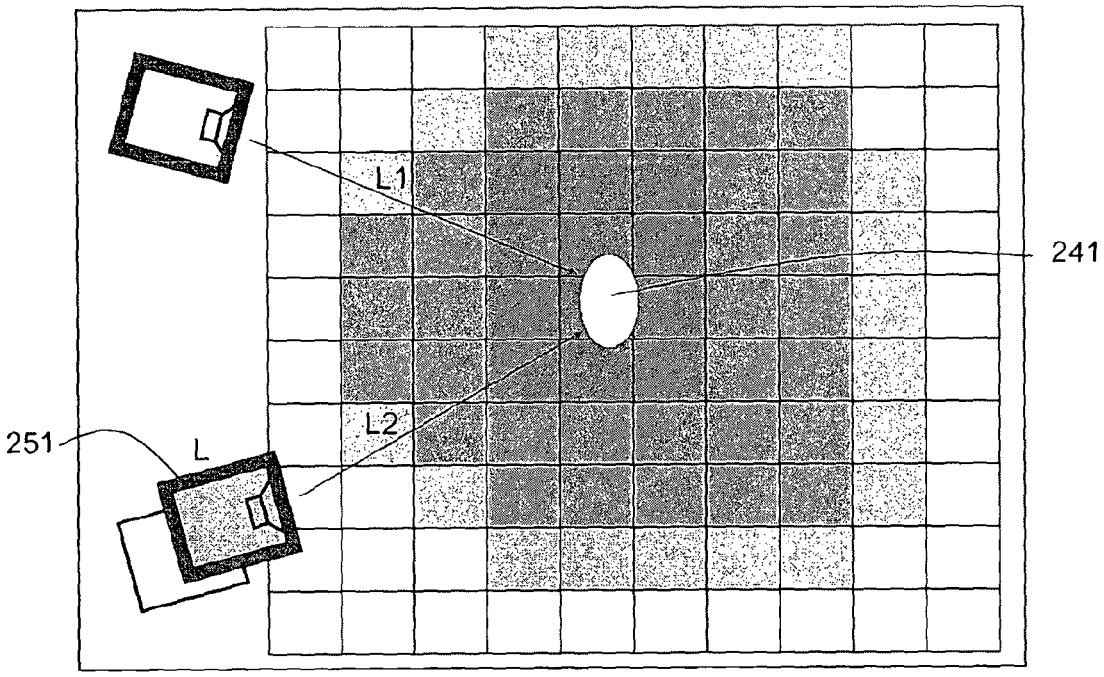
FIG. 25 illustrates the virtual position of the left speaker when delay compensation is applied to the situation shown in FIG. 24.

FIG. 24 illustrates the need for time delay corrections to be applied. In FIG. 24, a user selected central listening area 241 lies at distances L1 and L2 from the right and left speakers respectively where L1 does not equal L2. The delay correction parameter is therefore set to introduce a delay in the relative timing of audio signals to be supplied to the speakers 4 and 5 when reproducing sound in order to compensate for this effect.

Figure 5:
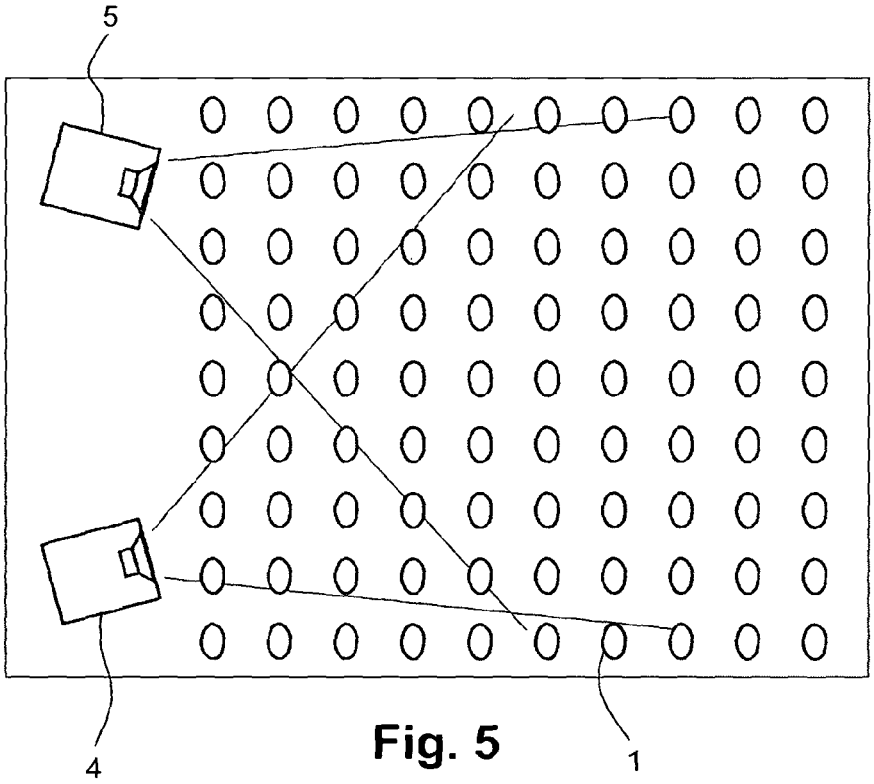
FIG. 5 illustrates schematically possible microphone positions during data acquisition.
Figure 6:
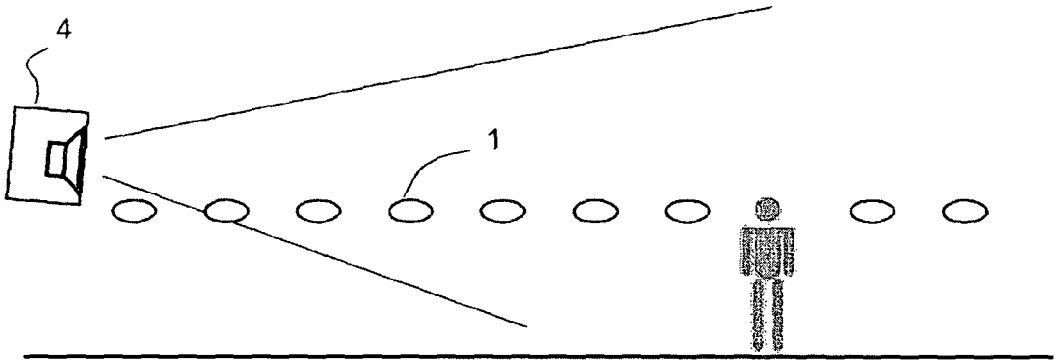
FIG. 6 illustrates microphone positions of FIG. 5 in side elevation.

This correction may viewed as in FIG. 5 as placing the left speaker 4 at a virtual position 251 such that L1=L2.

Figure 30:
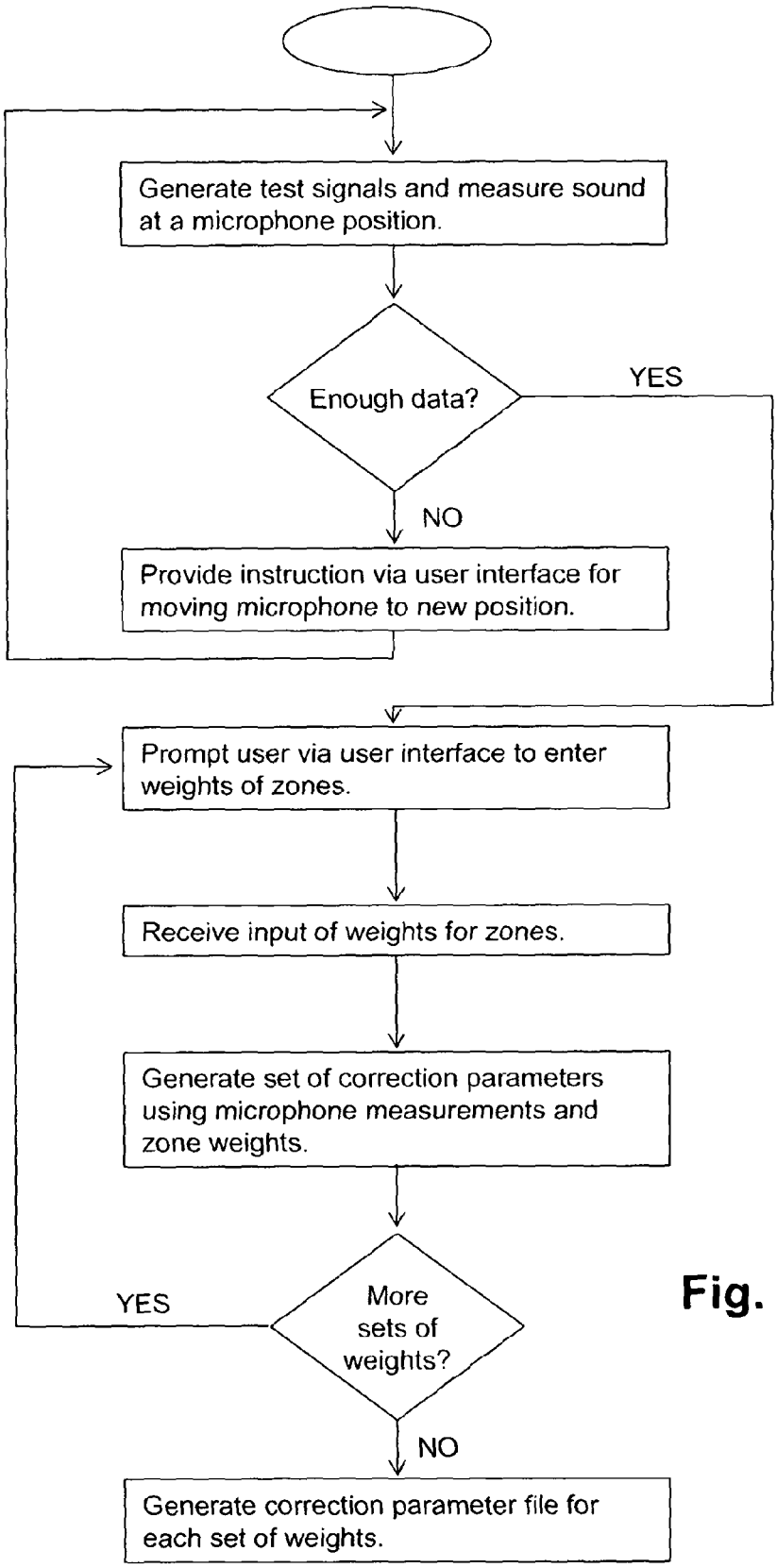
FIG. 30 is a schematic flow chart of the method of an embodiment.

FIG. 30 illustrates schematically the overall method of acquiring measurements and generating correction parameter files.

Apparatus for Implementing the Above Method

Figure 26:
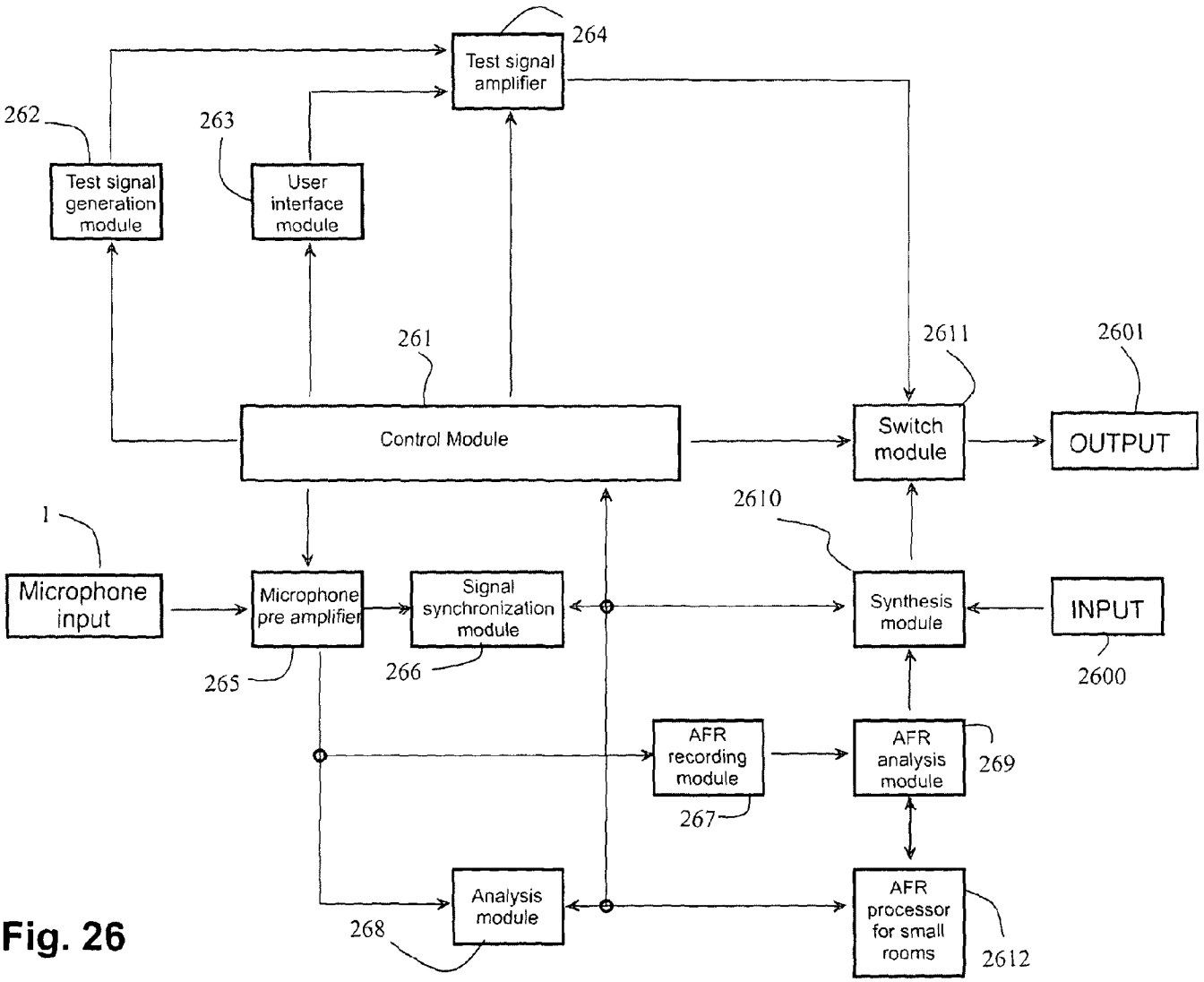
FIG. 26 is a block diagram of apparatus for implementing the method.

FIG. 26 illustrates schematically the functional elements of the apparatus required to perform the required method steps. The apparatus in this example generates a filter file for subsequent use by the same apparatus in processing sound signals when in an operational mode, following a calibration mode in which the test signals are generated, measurements taken and analysed, and the filter file generated.

A switch module 2611 provides appropriate signal switching according to whether the apparatus is in calibration mode or operational mode. The term "calibration mode" is here used to indicate that the system 2 is still in the process of acquiring data, receiving user preferences and generating the filter file. "Operational mode" indicates that the system is using a filter file to condition audio signals supplied to the speakers. During operational mode, synthesis module 2610 receives audio signals from an input 2600 and uses the filter file to apply the corrected AFR, signal levels and time delay corrections to obtain transformed output signals which are output to the audio output 2601. The output audio signals are amplified and supplied to the speakers 4 and 5.

A control module 261 manages interactions with the use for configuring the system 2 and progressing the data acquiring steps. A test signal generation module 262 is provided for generating the required test signals referred to above in the set-up and measurement stages. A user interface module 263 generates synthesised voice outputs and graphics displays used in prompts to the user and providing positioning feedback information during microphone placement, as well as managing user selection of available options including zone weights.

Test signal amplifier 264 amplifies test signals provided by the test signal generation module 264 and user interface module 263. Microphone preamplifier 265 amplifies signals from the microphone 1 and transmits them to signal synchronisation module 6 which is responsible for detection of signal timing and synchronisation of other modules.

AFR recording module 267 is responsible to recording all measurement results in memory.

Analysis module 268 analyses the location of the measurement microphone 1 and determines spatial reverberation parameters. AFR analysis module 269 performs analysis of the recorded measurements to obtain AFR information and the synthesis module 2610 generates the corrected AFR, corrections of the signal levels across the channels and time delay parameters taking into account all of the settings configured by the user.

Figure 31:
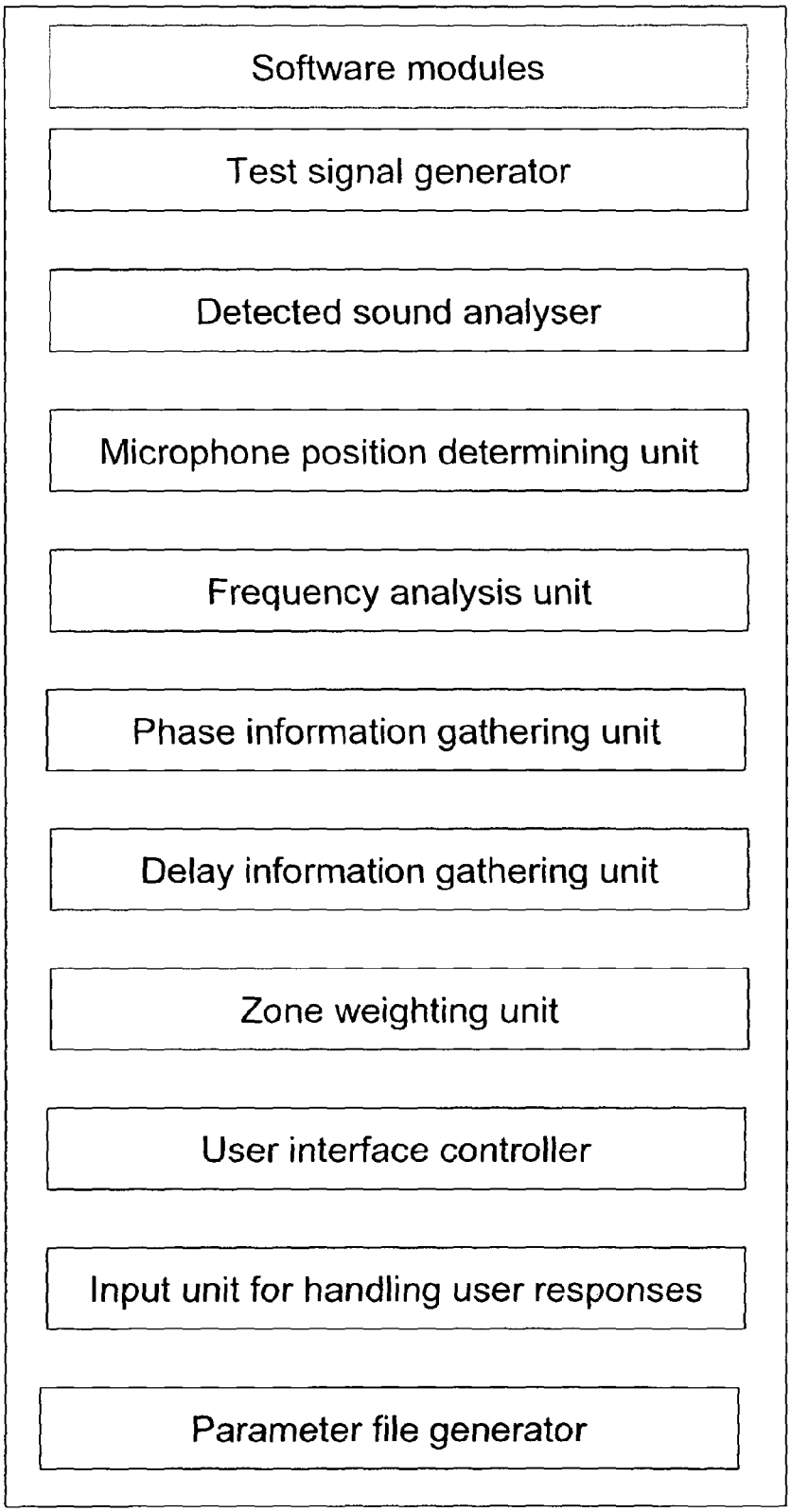
FIG. 31 is a schematic diagram showing software modules.

FIG. 30 illustrates schematically the overall method of acquiring and processing data. These steps may be implemented in software for example by incorporating a number of functional modules as shown schematically in FIG. 31.

Reproducing Sound Using Correction Parameters

Figure 27:
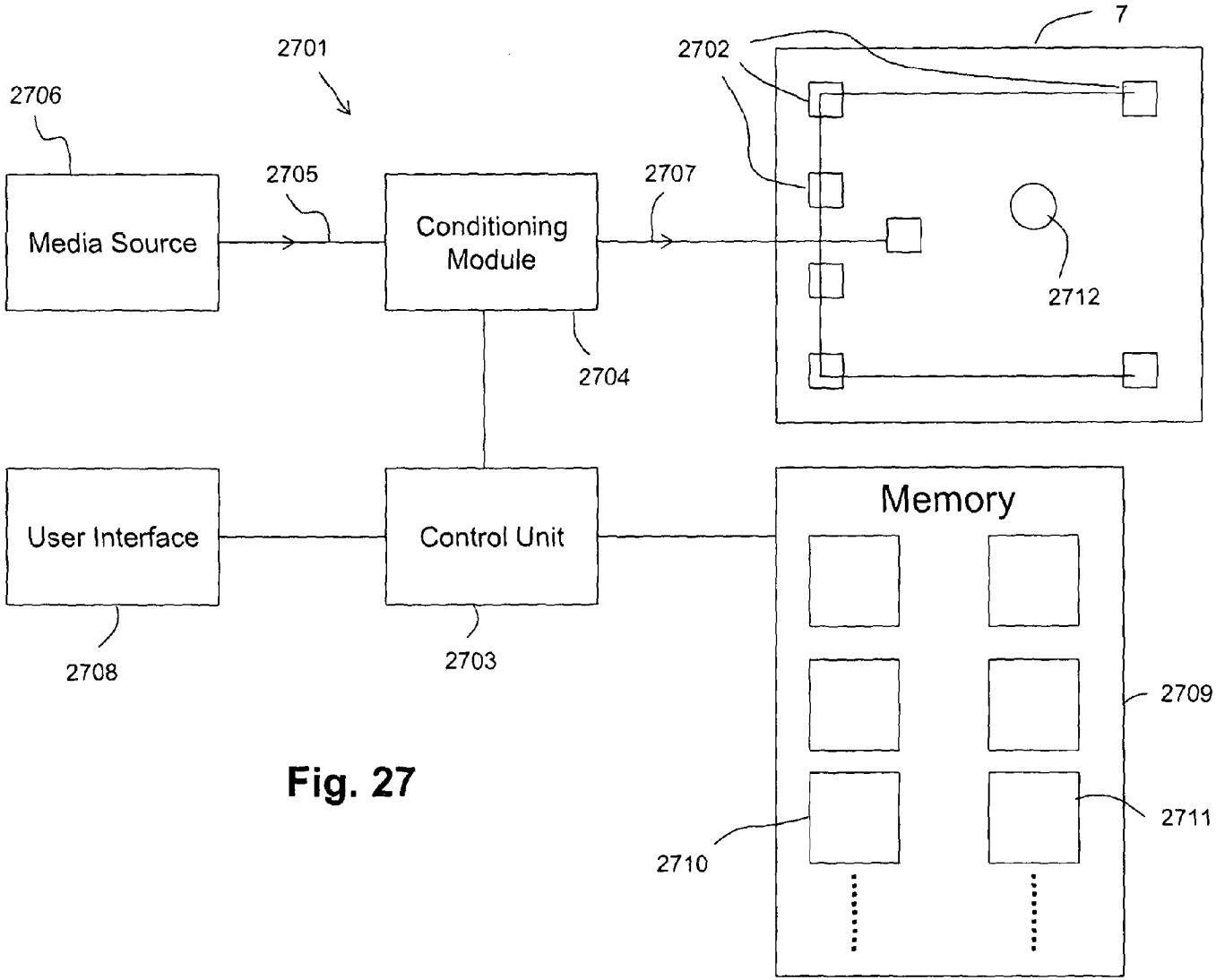
FIG. 27 is a schematic diagram of a sound reproduction system.

FIG. 27 shows a system 2701 for producing sound via an array of multiple speakers 2702 in a listening environment 7. A control unit 2703 controls operation of a conditioning model 2704 which is arranged to condition audio signals 2705 from a media source 2706 to produce output signals 2707. These output signals 2707 may be power level signals for driving passive speakers or line level signals for driving active speakers.

The control unit is linked to a user interface 2708 and to a memory 2709.

The memory 2709 stores multiple sets of correction parameters 2710 together with respective metadata 2711 which defines the user listening area preference corresponding to a given correction parameter set.

The control unit 2703 may be arranged to have a default setting in which a default set of correction parameters is used. When receiving the required user selection from the user interface 2708, the user may require a particular arrangement of listening position, for example to listen at a location 2712. The metadata 2711 for each of the sets of correction parameters 2711 collectively defines a set of presets which may be accessed by the user interface. Selection by the user of the preset corresponding to metadata 2711 results in the set of correction parameters 2710 being loaded into the control unit and used to program the conditioning module 2704.

The audio signals 2705 are then processed during playback of sound supplied by the media source 2706 such that the required user selection of frequency characteristic, delay and phase correction are supplied to the speakers 2702 and are perceived by the user at listening location 2712 as being in accordance with his selection.

Different presets may be required for example to accommodate situations where only one person is listening, a group of persons are listening, a group of persons are listening at a particular location, for example along a back wall of the listening room, or whether the listener is a sound engineer using a subset of the speakers for mastering and at a predefined location relative to near field monitors.

It is also within the scope of the present embodiment for different sets of speakers to be arranged within the same listening environment and to be selected with appropriate data stored in memory for applying the user selection of signal conditioning using the conditioning model 2704.

Figure 28:
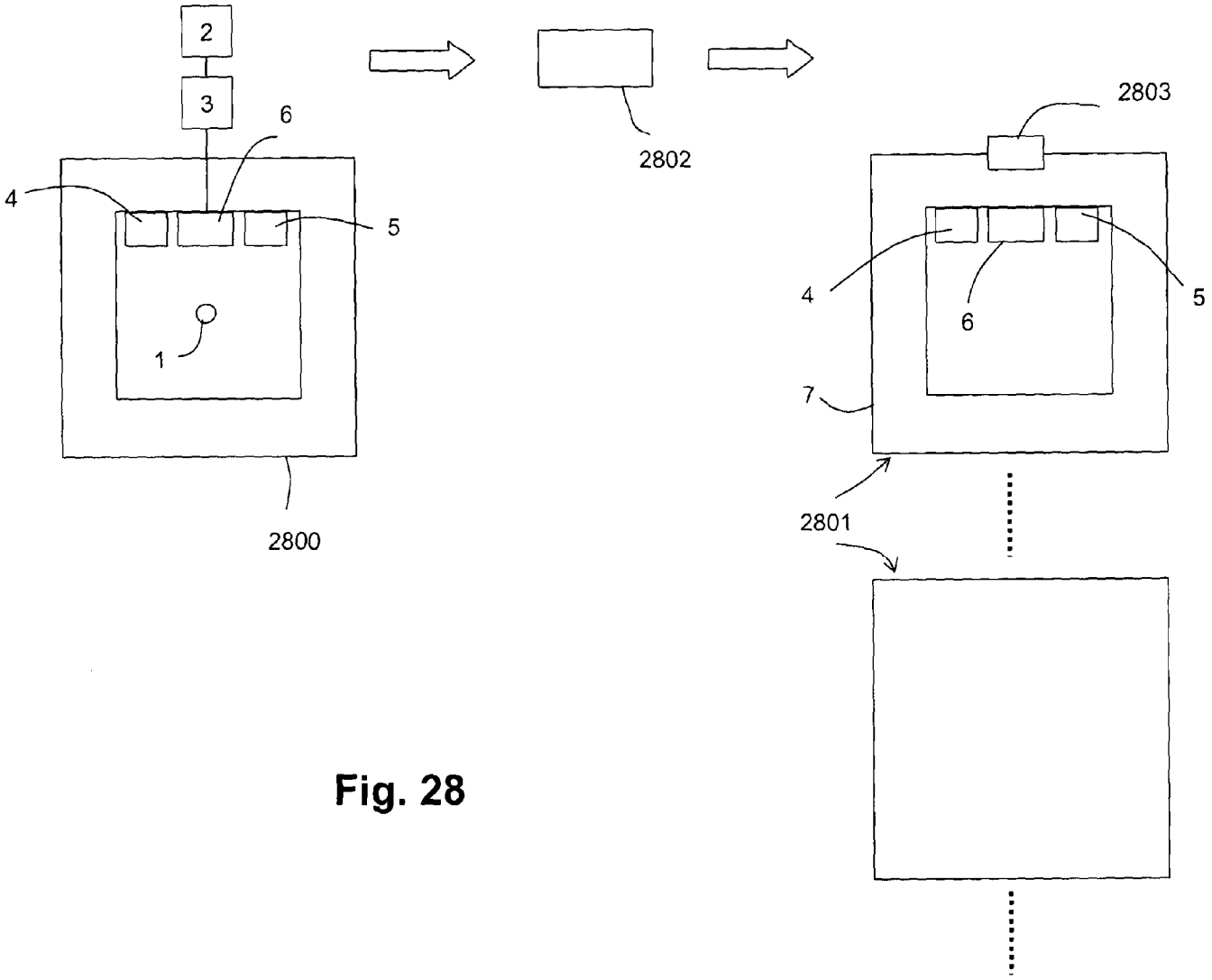
FIG. 28 is a schematic diagram of a method product production.

FIG. 28 illustrates schematically a manufacturing process for products 2801 which in this example are automotive vehicles having sound systems within the vehicle interior. The sound systems include left and right-hand speakers 4 and 5 and a user interface 6.

A test product 2800, i.e. a test vehicle, is connected to computer system 2 and audio interface 3 driving the speakers 4 and 5 and coupled to the user interface 6. A microphone 1 is used in the acquisition of data as described in the above method.

Correction parameters are generated using the system 2 as described above and are exported from the system as a parameter file 2802. The parameter file is loaded into the control system 2803 of the product 2801 during manufacture and the signals supplied to speakers 4 and 5 during sound reproduction from a media source are conditioned according to the parameter file 2802 in a similar way to the method described above with reference to FIG. 27. The driver of a vehicle may therefore receive optimum conditioned sound according to his preference. He may for example select single occupancy listening position in which only the driver receives optimum sound. Alternatively, he may select a listening position appropriate to having passengers in one or more of the vehicle seats so that they collectively receive sound conditioned in an optimal way to take account of the acoustic environment 7 within the vehicle.

As mentioned above, the configuration of FIGS. 1 and 2 can form part of a recording studio or mastering suite, or facility for post-production of media where precise listening to the media is essential. In this context, the present invention may be embodied as a software package to run on the same computer system 2 as will be used for the sound recording and editing facility. The software package may be supplied together with a suitable microphone 1. On installing the software, the computer system 2 then proceeds to direct the user through the stages described above in acquiring data and exporting a parameter file containing one or more sets of correction parameters for a corresponding one or more sets of user preference for listening location. The exported file may then in one embodiment be stored and input to a VST (virtual studio technology) plugin. The computer system then functions as a digital audio workstation in which the VST plugin in accordance with the above described embodiments, allows conditioning of media upon playback for listening in an optimised manner according to user preference of listening location. Other types of plugin may be used in other embodiments and the exported file configured accordingly, This is illustrated schematically in FIG. 29 where system 2900 represents the components shown in FIGS. 1 and 2. Software 2901 embodying the methods described above for acquiring and processing data and generating parameters is installed into the system and operated in the above described manner to produce ultimately a parameter file 2905 which is stored in system memory 2902.

In FIG. 29B the parameter file 2901 is loaded into a system 2906 when it is required to process audio signals from media source 2903 which may for example be audio signals recorded in multi-track form and mixed into stereo output as output signals 2904. The system 2906 may by default use a preferred set of correction parameters from the parameter file 2901. The user however may input via user interface 6 a preference for listening position. The system 2906 then selects according to metadata associated with the user selection an appropriate set of correction parameters to apply in digitally filtering and conditioning with appropriate delay and phase correction parameters the audio signal from the media source 2903.

In FIG. 29B the system 2906 may be the same system 2900 used to acquire the measurement data referred to above. Alternatively, the system 2906 may be a separate system at the same location, using a different processor, so that for example the system 2900 could be a computer system used with the appropriate software during the set-up stage of the system 2906 which subsequently is used for sound reproduction. The memory 2902 may for example be a storage medium such as a CD ROM, flash storage media, or remote storage available over a network such as the Internet where for example it may be that the data is saved in a server and is supplied to the system 2901 as an electronic signal.

The embodiments of the present invention may take the form of a software package supplied to the user of a system such as a personal computer. The software package would include modules for implementing the above described method of generating correction parameters and applying the correction parameters, together with appropriate drivers for interfacing with hardware. The software package may be delivered as a disc or other storage medium or alternatively may be downloaded as a signal, for example over the internet. Aspects of the present invention therefore include both a storage medium storing program instructions for carrying out the method when executed by a computer and an electronic signal communicating instructions which when executed will carry about the above described methods.

In one embodiment, the present invention is made available as a VST plugin for use in a digital audio workstation to provide the host application with additional functionality. In such a scenario, a software program may be provided for configuring the system for acquiring and processing data to obtain correction parameter files and the VST plugin may be used for conditioning audio signals using the data contained in the correction parameter files.

Such a VST plugin may have a user interface allowing the conditioning effect applied to audio signals to be applied 100%, bypassed completely, or applied at some proportion of 0 to 100%.

In further embodiments, software for allowing the system to condition audio data in a user selectable manner according to preference of listening position may be installed in firmware in the sound producing system which may be an audio system or an audio visual system such as a television, home cinema or hifi setup.

The above embodiments are described in relation to simple stereo left and right-hand speakers but the invention is readily adapted to surround sound systems in various configurations having more than two speakers.

The above described embodiments refer to acoustic triangulation as a method of identifying microphone position based on test signals supplied to speakers. Alternative embodiments are envisaged in which other methods of position measurement are used. Position data may be acquired for example using optical means of microphone position tracking, ultrasonic position location using separate transducers, or any other type of position location allowing microphone position coordinates to be determined and input to the system 2.

In the listening area definition stage, the above described embodiment locates the corners of the environment. Alternative procedures are envisaged in which microphones are positioned against the walls of the room to allow the position of the walls to be determined, and hence the outline co-ordinates of the listening environment determined.

In the above described embodiments, latency in the system is determined by measurement. Alternative embodiments are envisaged in which the latency is determined by a calculation based on knowledge of the system as a whole and the calculated value used in subsequent computations.

In the above described embodiment, frequency response test signals are described as comprising a sinusoidal signal of swept frequency. The frequency can of course be swept up or down. Alternatively, the frequency can be stepped in a manner which is not considered to be swept but nevertheless covers all of the available and necessary frequency measurements.

Although conveniently the invention may be embodied in the form of software supplied to a computer system, alternative implementations include hardware solutions.

The target AFR curve may in alternative embodiments be configured to achieve a correction curve which emulates performance of another speaker system of known characteristics, or features of another listening environment of known characteristics.

The invention claimed is:

1. A method of operating a system having a plurality of electro-acoustic transducers deployed in a listening environment, the method comprising a step of acquiring data for determining characteristics of an acoustic field generated by at least one of the electro-acoustic transducers of the system, the acquiring data step comprising;

measuring sound produced in response to test signals supplied to the electro-acoustic transducers, a respective sound measurement being made at each of a plurality of microphone positions within the listening environment, each test signal comprising a frequency response test signal supplied to one or more of the plurality of electro-acoustic transducers;

for each sound measurement, calculating microphone position data representing the microphone position relative to positions of the electro-acoustic transducers, and determining frequency response data detected by the microphone in response to sound produced by the one or more electro-acoustic transducers receiving the frequency response test signal; and generating a set of parameters reflecting a weighted frequency response curve, the set of parameters being calculated from the frequency response data weighted in proportion to a distance between a listening spot within the listening environment and the microphone position.

2. A method as claimed in claim 1 wherein generating the set of parameters comprises generating a set of correction parameters to be applied to an audio signal during sound production, the set of correction parameters being calculated from the frequency response data and calculated to provide values needed to control an equalization filter to achieve a desired frequency response characteristic within the listening environment.

3. A method as claimed in claim 2 further comprising receiving via a user interface an indication of a preferred listening spot as the listening spot.

4. A method as claimed in claim 3 comprising calculating delay and level adjustment data for the listener at the preferred listening spot, and including the delay and level adjustment data in the set of correction parameters.

5. A method as claimed in claim 3 wherein the acquiring data step comprises acquiring data for a plurality of zones within the listening environment, wherein at least a sub-plurality are assigned a weight index in proportion to a distance between the preferred listening spot and each of the at least sub-plurality of zones.

6. A method as claimed in claim 5, wherein the plurality of zones substantially span the listening environment.

7. A method as claimed in claim 5 wherein the listening environment is divided into a number of zones according to a user input, the method further comprising indicating, via the user interface, a plurality of options and receiving the user input for the number of zones into which the listening environment is to be divided.

8. A method as claimed in claim 5 wherein the user interface provides a map of the zones and an indication of current microphone position, and a representation of microphone positions for which measurements have been made.

9. A method as claimed in claim 5 wherein the method further comprises receiving a user-selected weight for respective zones.

10. A method as claimed in claim 9 including receiving multiple sets of weights, each set of weights corresponding to a different preferred listening position, and generating a corresponding plurality of sets of correction parameters.

11. A method as claimed in claim 5 wherein the assigned weight indices are applied to data in each of the at least sub-plurality of zones only in respect of data for sound having a frequency above or below a cut-off frequency.

12. A method as claimed in claim 5, wherein the assigned weight indices comprise at least a sub-plurality of weight indices of a value between 0 and 1 in proportion to the distance between the listening spot within the listening environment and each of the at least sub-plurality of zones, wherein 1 indicates a main listening zone at or nearer the preferred listening spot relative to other zones.

13. A method as claimed in claim 1 wherein the correction parameters further comprise at least one of phase correction parameters and delay correction parameters.

14. A measurement system having a plurality of electro-acoustic transducers deployed in a listening environment, the measurement system being adapted to acquire data for determining characteristics of an acoustic field generated by at least one of the electro-acoustic transducers of the system, the system comprising:

a test signal generator;

a detected sound analyzer adapted to measure sound produced in response to test signals supplied by the test signal generator to the electro-acoustic transducers, a respective sound measurement being made at each of a plurality of microphone positions within the listening environment, each test signal comprising a frequency response test signal supplied to one or more of the plurality of electro-acoustic transducers; and a microphone position determining unit adapted, for each sound measurement, to calculate microphone position data representing the microphone position relative to positions of the electro-acoustic transducers;

a frequency analysis unit adapted to determine frequency response data detected by the microphone in response to sound produced by the one or more electro-acoustic transducers receiving the frequency response test signal; and a parameter generator adapted to generate a set of parameters reflecting a weighted frequency response curve, the set of parameters being calculated from the frequency response data weighted in proportion to a distance between a listening spot within the listening environment and the microphone position.

15. A system as claimed in claim 14 wherein the parameter generated is adapted to generating a set of correction parameters to be applied to an audio signal during sound production, the set of correction parameters being calculated from the frequency response data and calculated to provide values needed to control an equalization filter to achieve a desired frequency response characteristic within the listening environment.

16. A system as claimed in claim 15 further comprising a user interface controller adapted to receive via the user interface an indication of a preferred listening spot as the listening spot.

17. A system as claimed in claim 16 comprising a phase information unit and a delay information unit adapted to calculate delay and level adjustment data for the listener at the preferred listening spot, for including the delay and level adjustment data in the set of correction parameters.

18. A system as claimed in claim 16 adapted to acquire data for a plurality of zones within the listening environment and assign at least a sub-plurality of zones a weight index in proportion to a distance between the preferred listening spot and each of the at least sub-plurality of zones.

19. A system as claimed in claim 18 wherein the listening environment is divided into a number of zones according to a user input, the system being adapted to indicate via the user interface a plurality of options and to receive the user input for the number of zones into which the listening environment is to be divided.

20. A system as claimed in claim 18 adapted to provide via the user interface a map of the zones and an indication of current microphone position, and a representation of microphone positions for which measurements have been made.

21. A system as claimed in claim 18 comprising a zone weighting unit adapted to receive a user selected weight for respective zones.

22. A system as claimed in claim 21 wherein the zone weighting unit is adapted to receive multiple sets of weights, each set of weights corresponding to a different user preference for listening position, and generate a corresponding plurality of sets of correction parameters.

23. A system as claimed in claim 18 wherein the assigned weight indices are applied to data in each of the at least sub-plurality of zones only in respect of data for sound having a frequency above or below a cut-off frequency.

24. A system as claimed in claim 18 wherein the assigned weight indices comprise at least a sub-plurality of weight indices of a value between 0 and 1 in proportion to the distance between the listening spot within the listening environment and the microphone position, wherein 1 indicates a main listening zone at or nearer the preferred listening spot relative to other zones.

25. A system as claimed in claim 14 wherein the correction parameters further comprise at least one of phase correction parameters and delay correction parameters.

* * * * *